US007525527B2

(12) United States Patent
Sekine

(10) Patent No.: US 7,525,527 B2
(45) Date of Patent: Apr. 28, 2009

(54) METHOD FOR DRIVING A LIQUID CRYSTAL DISPLAY DEVICE

(75) Inventor: Hiroyuki Sekine, Tokyo (JP)

(73) Assignee: NEC Corporation, Tokyo (JP)

( * ) Notice: Subject to any disclaimer, the term of this patent is extended or adjusted under 35 U.S.C. 154(b) by 675 days.

(21) Appl. No.: 10/900,187

(22) Filed: Jul. 28, 2004

(65) Prior Publication Data

US 2005/0030269 A1 Feb. 10, 2005

(30) Foreign Application Priority Data

Aug. 7, 2003 (JP) ..... 2003-288987

(51) Int. Cl.
*G09G 3/36* (2006.01)

(52) U.S. Cl. ..... 345/87; 345/103

(58) Field of Classification Search ..... 345/87–103
See application file for complete search history.

(56) References Cited

U.S. PATENT DOCUMENTS 6,563,482 B1 * 5/2003 Yamazaki et al. ..... 345/87
6,624,801 B2 * 9/2003 Moriyama ..... 345/100
7,218,309 B2 * 5/2007 Uchino et al. ..... 345/103

FOREIGN PATENT DOCUMENTS

JP 2001-92426 4/2001

* cited by examiner

*Primary Examiner*—Amare Mengistu
*Assistant Examiner*—Jennifer Zubajlo
(74) *Attorney, Agent, or Firm*—Young & Thompson

(57) ABSTRACT

In a liquid crystal display device, a pixel matrix is divided into a plurality of pixel regions in unit of pixel column. The pixel matrix is driven so that video signals having the same polarity are written into every divided pixel regions and video signals having different polarities are written into adjacent pixel regions during a vertical period during which signals of one screen are written and the polarity of the video signals is alternately changed every vertical period.

7 Claims, 21 Drawing Sheets

METHOD FOR DRIVING A LIQUID CRYSTAL DISPLAY DEVICE

FIELD OF THE INVENTION

The present invention relates to a liquid crystal display device and in particular to an active matrix type liquid crystal display device and an electronic device having the same.

BACKGROUND OF THE INVENTION

In liquid crystal display devices, it is necessary to conduct an alternating current drive in which the polarity of a voltage applied to a liquid crystal is alternately changed for every frame. The reason resides in that continuous application of a voltage having a DC (direct current) component to a liquid crystal causes impurity-ions contained in the liquid crystal material at a very small amount are gathered around an electrode, thereby making it difficult to apply a correct voltage upon the liquid crystal. Therefore, conventional active matrix type liquid crystal display devices use the driving method as follows:

A gate line inversion driving method for alternately changing the polarity of a signal which is written to pixels with respect to a common electrode for every pixel row;

A data line inversion driving method for alternately changing the polarity of a signal for every pixel column; or A dot inversion driving method for changing the polarity of a signal in a pixel unit in a checkered pattern manner.

These methods do not only achieve the above-mentioned alternating current drive, but also are advantageous to reduce flickering. The reason resides in that these methods spaciously average slight differences between the transmittances when signals having positive and negative polarities are written in pixels, so that flicker which perceived by human eyes can be reduced.

One of causes of the transmittance difference which is generated even when positive and negative polarity signals are written in pixels is a variation of a voltage applied to the pixels due to leakage current from a pixel transistor. It is a liquid crystal display device used for a projector that is most influenced by this problem. The reason is that it is necessary to irradiate the liquid crystal with very strong light in order to project a bright image from the projector, so that photo-leakage current from the pixel transistor becomes larger.

One of the performances required for the liquid crystal devices for the projector is high transmittance. It is necessary to provide a high aperture ratio which is a ratio of an area which transmits light with respect to the whole area of each pixel in order to increase the transmittance. In order to increase the aperture ratio, it is necessary to reduce an area on which wiring, pixel transistor and storage capacitor are formed and to decrease an area on which the orientation of molecules of liquid crystal is disturbed at the edge of a pixel electrode. The lowering of the aperture ratio due to orientation disturbance of liquid crystal molecules becomes serious particularly in such a high-resolution liquid crystal display device having a pixel pitch of 20 μm or less. The orientation disturbance of the liquid crystal molecules occurs due to the fact that the liquid crystal molecules have a tendency to orient along a lateral electric field due to the potential difference between adjacent pixel electrodes. The orientation disturbance is most remarkable if signals having different polarities are written into adjacent pixels. As a technique for preventing the orientation disturbance from occurring, there has been a used a frame inversion driving method in which signals having same polarity are written into all of pixels of the liquid crystal display device. However, this frame inversion driving method has a problem that the flicker becomes larger.

A technique to avoid this problem is described in Patent Document 1 described below. A method disclosed in Patent Document 1 reduces screen flicker by shortening the frame period during which signals of one screen are written into the liquid crystal display device even if the frame inversion driving method is used. In this method, a first video signal having the same polarity is applied to a plurality of pixel electrodes via a plurality of source signal lines (data signal lines) in a first frame period and then a second video signal having the polarity opposite to that of the first video signal is applied to a plurality of pixel electrodes via a plurality of source signal lines (data signal lines) in a frame period subsequent to the first frame period. The first and second frame period is set to 8.3 ms or less. In such a manner, this method reduces the voltage variation ascribable to leakage current from a pixel transistor by driving the liquid crystal display device at a frame frequency of 120 Hz or higher, which is not less than double the conventional frequency. This method utilizes a fact that flickering is hard to perceive for human eyes when the screen is rewritten at a high speed.

[Patent Document 1]

JP-P2001-92426A (page 5, 6 and FIG. 1)

SUMMARY OF THE DISCLOSURE

However, the driving method as set forth in Patent Document 1 has another problem that unevenness of brightness occurs on the screen if photo-leakage current of a pixel transistor is large. The reason of occurrence of the brightness unevenness will now be described. The problem which will be described is based upon the results of present inventor's study.

FIG. 19 is a diagram schematically showing a conventional active matrix type liquid crystal display device. A pixel, an equivalent circuit of which is shown in FIG. 3 is provided in the vicinity of each of intersections between data lines 12 and gate lines 11 in a pixel matrix. Referring to FIG. 3, the pixel comprises a pixel transistor 13 having its gate and source connected to the gate and data lines 11 and 12, respectively, a storage capacitor 14 having one end connected to the drain of the pixel and the other end connected to a storage capacitor line 16 and a pixel capacitor which is connected to the drain of the pixel transistor 13 and which is made up of a pixel electrode, liquid crystal cell and common electrode.

FIG. 20 is a timing chart showing an operation in which the liquid crystal display device is driven by the frame inversion driving method for writing signals which cause all of the pixels to display black spots. The liquid crystal display device is in a normally white mode in which its transmittance is high when no electric field is applied to the liquid crystal.

In FIG. 20, a period Tf denotes one frame period in which video signals are written to all of pixels in the liquid crystal display device. An example in which signals are sequentially written from the upper end to the lower end of the liquid crystal display device of FIG. 19 is shown in FIG. 20.

In FIG. 20, Dj denotes a potential of a desired data line j (Dj in FIG. 19). G1 to Gk denote respective potentials of the gate lines 1 to k (G to Gk in FIG. 19).

P1, j denotes a potential of the pixel electrode in a pixel in 1st pixel row and j-th pixel column (a pixel at an intersection of a gate line G1 with a data line Dj).

Pk, j also denotes a potential of a pixel electrode in a pixel in k-th pixel row and j-th pixel column (a pixel at the intersection of a gate like Gk and a data line Dj).

Vcom denotes a potential of a common electrode. The pixel electrode is connected to the drain of the pixel transistor 13. The liquid crystal cell is sandwiched between the pixel electrode and opposite common electrode to form the pixel capacitor 15. In the following description, Pi, j is also used to denote a pixel positioned at an intersection between i-th row and j-th column.

As shown in FIG. 20, a pluse is applied to the gate line G1 during a period Tf (one vertical period). A signal voltage (video signal) which is applied to the data line Dj at this time is applied to a pixel electrode of a pixel P1, j via the pixel transistor which is turned on. After turning off of the pixel transistor in question, the written signal voltage is held by the storage capacitor of the pixel in question. Then, pulses are sequentially applied to the gate lines G2 and G3, so that video signal voltages are applied to the respective pixel electrodes of the pixels P2, j and P3, j in second and third rows and held. Finally, a video signal is written in pixel Pk, j in k-th pixel row.

FIG. 21 shows the drain-to-source voltage Vds of a pixel transistor constituting a pixel P1, j to which a signal is firstly written during one frame period and the drain-to-source voltage Vds of a pixel transistor constituting a pixel Pk, j to which a signal is finally written. As shown in FIG. 21, the drain-to-source voltage Vds (1, j) of the pixel P1, j to which the signal is firstly written is substantially zero and there is no potential difference during most of the period since a voltage which has been written into the pixel is continuously applied to the data line Dj after the signal has been written into the pixel.

In contrast to this, immediately after the data signal Dj has been written into the pixel Pk, j in response to a pulse signal applied to the gate line Gk (Vds(k, j)=0V at this time), next frame period begins. Since the polarity of the signal supplied to the data line changes during this period, the potential difference (variation) in the drain-to-source voltage Vds (k, j) of the pixel transistor during the period Tf becomes large.

The leakage current from the pixel transistor becomes larger depending upon the drain-to-source voltage Vds. The pixel Pk, j having a larger potential difference in the drain-to-source voltage has larger leakage current, as a result of which, the voltage fluctuation of the pixel electrode becomes larger. Therefore, the pixels which are located in lower positions on the screen exhibit larger voltage fluctuation in the pixel electrodes. The transmittance of the screen becomes higher in lower position thereof although the same signal voltage is applied to all pixels. This is the reason why an unevenness of brightness occurs on the screen of the liquid crystal display device.

SUMMARY OF THE INVENTION

Accordingly, it is an object of the present invention to provide a liquid crystal display device which provides a high aperture ratio.

Another object of the present invention is to provide a liquid crystal display device which is capable reducing the unevenness of brightness over the screen and flicker.

The above and other objects are attained by a liquid crystal display device, in accordance with one aspect of the present invention, comprising: a plurality of data lines arrayed in parallel; a plurality of gate lines arrayed in parallel along a direction perpendicular to said data lines; a first substrate having a pixel matrix in which each of pixels comprising at least one pixel transistor, pixel capacitor and storage capacitor, is disposed in each of intersections of said data lines with said gate lines; a second substrate having a common electrode which is opposite to said first substrate; and a liquid crystal which is sandwiched between said first and second substrates, wherein the gate terminal of said pixel transistor being connected to said gate lines which are common to every pixel rows; the source terminal of said pixel transistor being connected to the data lines which are common to every pixel column, the drain electrode of said pixel transistor being connected to the pixel capacitor and the storage capacitor of the pixel corresponding to said pixel transistor, wherein said pixel matrix is divided into a plurality of pixel regions in unit of a plurality of gate lines;

wherein the polarities of the video signals which are written into the pixels from said data lines for every divided pixel regions relative to the potential of the common electrode are the same in one vertical period during which signals of one screen are written into said pixel matrix and the polarities of the video signals which are written into the pixels from said data lines are different in adjacent pixel regions, wherein video signals are supplied to the pixel regions so that the polarity of the signal to be written in each pixel region relative to the potential of the common electrode is alternately changed every vertical period;

wherein writing of video signals into said pixel matrix is conducted by writing video signals of one pixel row into one pixel region of said plurality of pixel regions and thereafter writing video signals of one pixel row into different pixel region until writing of the video signals for all pixel rows is completed; and wherein said liquid crystal display device further comprises means for selecting a pixel region into which said video signals from said data lines are written so that the polarity of a signal to be written into said pixel region relative to the potential of said common electrode is alternately changed every horizontal period.

In the liquid crystal display device according to the present invention, said pixel regions which are divided into n pixel regions have substantially equal number of pixel columns.

In the liquid crystal display device according to the present invention, the number of said divided pixel regions (n) is an even number.

In the liquid crystal display device according to the present invention, in case numbers are assigned to the pixel regions and the pixel rows in the pixel region, using as a reference, one of side edges of the liquid crystal display device, said side edges being parallel with a longitudinal a direction of the gate lines from the position nearest to one of side edges, writing of signals into all pixels in said pixel matrix is conducted by repeating the steps of writing of signals into the first pixel rows of the first to n-th pixel regions by writing signals into the first pixel row in the first pixel region, thereafter writing signals into the first row in the second pixel region and so on until writing of signals into the first pixel row in n-th pixel region; and subsequently writing signals into i-th pixel row of the first to n-th pixel regions by writing signals into i-th pixel row in the first pixel region, thereafter writing i-th pixel row in the second pixel region and so on until writing of signals into i-th pixel row in n-th pixel regions wherein i is incremented from 2 to k which is the number of pixel columns in pixel regions.

In a liquid crystal display device according to the present invention, said vertical period during which signals are once written into all pixels of said pixel matrix is 8.34 ms or less.

A method of driving a liquid crystal display device in accordance with another aspect of the present invention, wherein said pixel matrix is divided into a plurality of pixel regions in unit of a given number of pixel columns; said method comprising the steps of:

performing control so that in one vertical period during which signals of one frame are written into said pixel matrix, the polarities of the video signals written from said data lines into the pixels, relative to the potential of the common electrode, are the same in each of divided pixel regions, whereas in adjacent divided pixel regions, the polarities of the video signals written from said data lines into the pixels, relative to the potential of the common electrode are different;

performing control so that in supplying video signals from the data lines to the pixel region, the polarity of the signal written into each pixel region, relative to the potential of the common electrode, is alternately changed every vertical period;

for performing control of a sequence of writing of video signals into said pixel matrix so that writing of video signals for one pixel row into one pixel region of said plurality of pixel regions is conducted and thereafter writing of video signals for one pixel row into different pixel region is conducted until writing the video signals for all pixel rows into said pixel matrix is completed; and selecting a pixel region into which said video signals from said data lines are written so that the polarity of a signal to be written into said pixel region relative to the potential of said common electrode is alternately changed every horizontal period.

In a liquid crystal display device according the present invention, any one of a data line driver circuit for driving said data lines and a gate line driver circuit for driving said gate lines may be made of thin film transistors which are manufactured on said first substrate simultaneously with said pixel transistor.

A liquid crystal display device according to the present invention may comprise a precharge circuit for writing a given voltage on said data lines every one horizontal period during which signals of one pixel row of said pixel matrix are written.

A liquid crystal display device according to the present invention may be formed so that at least one of said pixel transistor, said data line driver circuit, said gate line driver circuit and said precharge circuit is made of a polysilicon thin film transistor.

The liquid crystal display device according to the present invention achieves a high aperture ratio of pixels and reduction in brightness unevenness on screen and flickering and is preferably used for liquid crystal projectors.

A liquid crystal display device according to the present invention may be formed so that a pigment layer which transmits any of colors R (red), G (green) and B (blue) to said pixels is disposed on any of said first active substrate and said second opposite substrate.

The liquid crystal display device according to the present invention may be used for liquid crystal monitors, portable terminal devices.

The meritorious effects of the present invention are summarized as follows.

Since the polarities of the video signals supplied to adjacent pixels relative to common electrode are the same in accordance with the present invention, lateral electric field which occurs in the pixel boundaries is small in strength, so that the region at which the orientation of the liquid crystal molecules is disturbed can be reduced. Therefore, portions which could not be utilized in the prior art can be used as an aperture, thereby achieving a high aperture ratio.

In accordance with the present invention, video signals having the same polarity relative to the common electrode are supplied to every divided pixel regions while the polarities of the video signals supplied to adjacent pixel regions are different. The order of writing video signals into the pixel matrix is determined so that the pixel regions are selected to make the polarity of the video signal to be written different every one horizontal period. Accordingly, the polarity of the video signals supplied to the data lines is alternately changed every one horizontal period. Thus, the average value of the drain-to-source voltage applied to pixel transistors in all positions in the pixel matrix can be uniformed. As a result, the brightness non-uniformity on the screen and flickering can be reduced.

In accordance with the present invention, the period which is taken to write signals of one screen to the liquid crystal display device can be shortened, so that voltage fluctuations due to photo-leakage current of pixel transistors can be reduced. As a result, flickering can be reduced.

Still other objects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED EMBODIMENTS OF THE INVENTION

Preferred embodiments of the invention of the present invention will be described. The configuration of the liquid crystal display device according to an embodiment of the present invention will, be described. In the liquid crystal display device according to an embodiment of the present invention, the pixel matrix is divided into a plurality of pixel regions in unit of a plurality of gate lines (pixel row).

Figure 2:
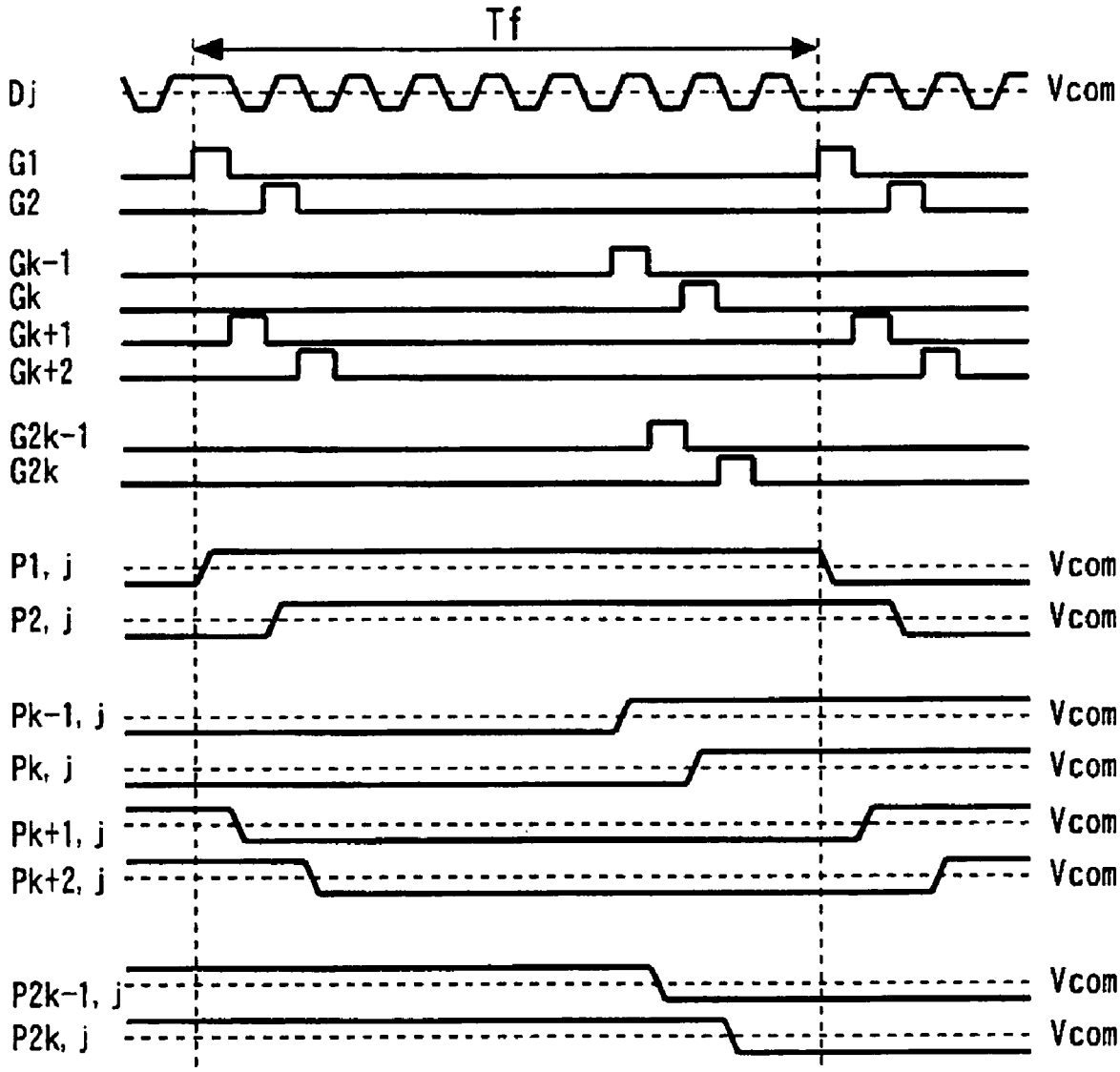
FIG. 2 is a timing chart explaining the operation of the liquid crystal display device according to the first embodiment of the present invention.

A method of driving in case wherein the pixel matrix is divided into two pixel regions in one embodiment of the present invention will be described with reference to timing chart of FIG. 2. As shown in FIG. 2, in one vertical period which is a time period taken for video signals of one screen to be written into the pixel matrix 10, the video signals which are written into each of the divided pixel regions have an identical polarity in regard to that of the common electrode potential Vcom and is different from that of a signal which is written adjacent pixel region. The voltage Dj (video signal) on the data line has such a voltage wave-form that the voltage has a positive and negative polarities which are alternating relative to that of the common electrode potential Vcom in every one horizontal period.

The video signal which is applied to the first pixel row of the pixel region 10-1 (Dj of the pulse output period of the gate line G1) assumes a positive polarity relative to the potential of the common electrode Vcom.

Subsequently, the video signal which is applied to the first pixel row of the pixel region 10-2 (Dj of the pulse output period of the gate line Gk+1) assumes a negative polarity relative to the potential of the common electrode Vcom.

Then, the video signal which is applied to second pixel row of the pixel region 10-2 (Dj of the pulse output period of the gate line Gk+2) assumes a positive polarity relative to the potential of the common electrode Vcom.

Subsequently, the video signal which is applied to second pixel rows of the pixel region 10-2 (Dj of the pulse output period of the gate line Gk+1) assumes a negative polarity relative to the potential of the common electrode Vcom.

In next vertical period after writing of one screen, the polarity of the video signal which is applied to each pixel region is a reversal of that in the previous vertical period.

That is, at next vertical period, the video signal which is applied to the first pixel row of the pixel region 10-1 (Dj of the pulse output period of the gate line G1) assumes a negative polarity relative to the potential of the common electrode Vcom.

Then, the video signal which is applied to the first pixel row of the pixel region 10-2 (Dj of the pulse output period of the gate line Gk+1) assumes a positive polarity relative to the potential of the common electrode Vcom.

The video signal which is applied to the second pixel rows of the pixel region 10-1 assumes a negative polarity relative to the potential of the common electrode Vcom.

Then the video signal which is applied to the second pixel rows of the pixel region 10-2 assumes a positive polarity relative to Vcom.

The order of writing signals into the pixel matrix 10 is determined in such a manner that signals for one pixel row are written into one pixel region of a plurality of (n) pixel regions and thereafter an operation to write signals of one pixel row into the other pixel regions is conducted for all pixel rows of the pixel matrix. Furthermore, pixel regions into which video signals are written so that the polarity of the signal to be written into the pixel region is alternately changed every horizontal period. In case the pixel matrix is divided into two pixel regions, the two pixel regions are alternately selected so that the polarity of the video signal is alternately changed if the pixel region is divided into two areas).

In accordance with the present invention, after signals are written into the first pixel row in the first pixel region, signals are written into the first pixel row of the second pixel region, and so on until signals are written into the first pixel row of the n-th pixel region, so that signals are written into the first pixel row of the first to n-th pixel regions. Similarly, after signals are written into the i-th pixel row of the first pixel region, signals are written into the i-th pixel row of the second pixel region and so on until signals are written into the i-th pixel row of the n-th pixel region.

Writing of signals in i-th pixel row of first to n-th pixel regions is successively repeated by incrementing i from 2 to k which is the number of pixel columns in the pixel region, so that writing of signals in all pixels in the pixel matrix is completed.

During next vertical period after writing of one screen, the liquid crystal display device is driven so that the polarity of the video signal applied to each pixel region is opposite to that of the previous vertical period.

Figure 1:
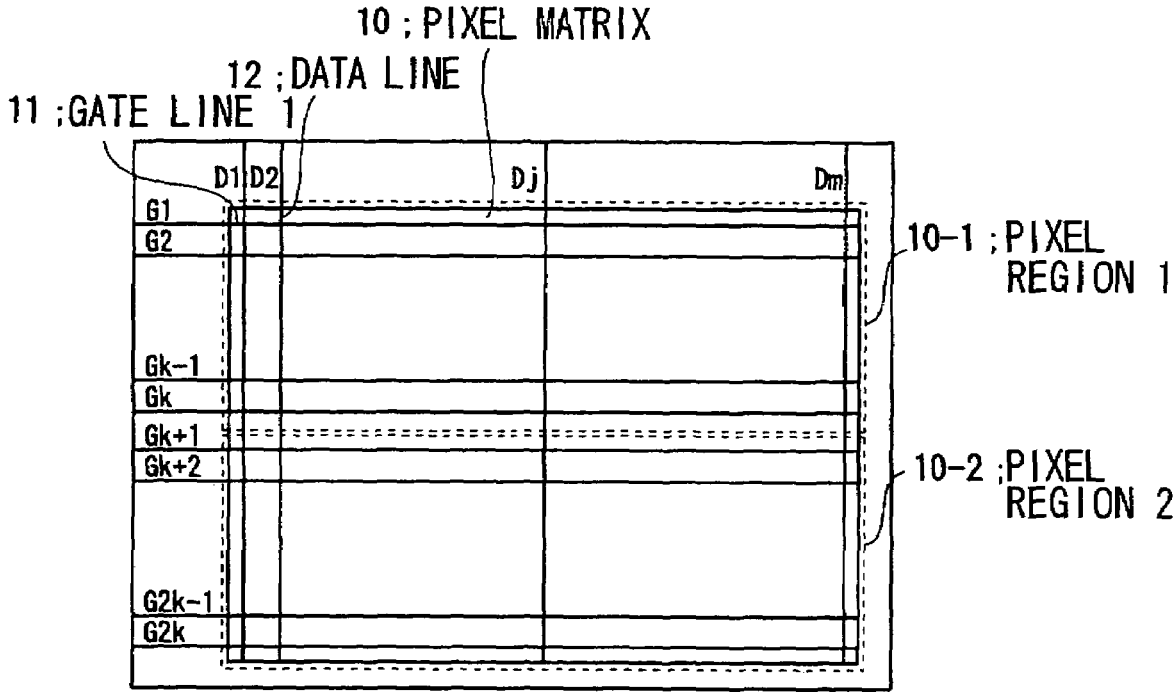
FIG. 1 is a diagram showing the configuration of the liquid crystal display device according to the first embodiment of the present invention.
Figure 3:
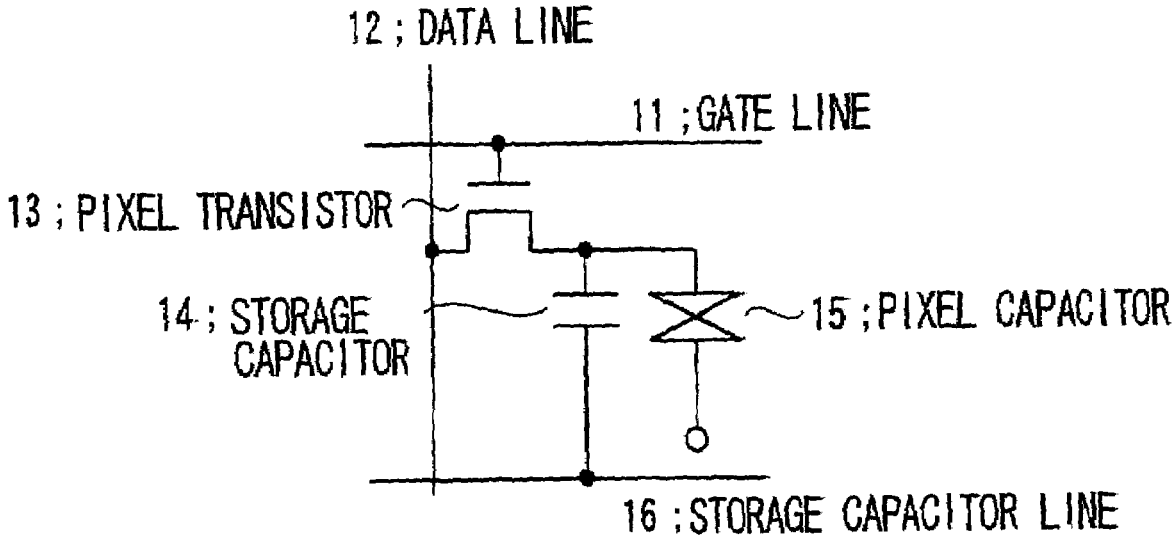
FIG. 3 is a diagram showing the equivalent circuit of a pixel of the liquid crystal display device according to the first embodiment of the present invention.

The present invention will now be described more in detail with reference to the drawings. FIG. 1 is a schematic diagram showing the configuration of a liquid crystal display device of one embodiment of the present invention. Referring to FIG. 1, the liquid crystal display device according to the present embodiment is of a structure wherein liquid crystal is sandwiched between a matrix substrate having a pixel matrix 10 and an opposite substrate (not shown) which is provided with a common electrode common to pixel capacitor of each of pixels in the pixel matrix 10. In the pixel matrix 10, pixels, each comprising a pixel transistor 13, pixel capacitor 15 and storage capacitor 14 are disposed at intersections of data lines 11 denoted as D1 through Dm with gate lines denoted as G1 through G2*k* as shown in FIG. 3. Referring now to FIG. 3, the pixel transistor 13 has its gate, source and drawherein are connected to the gate line 11, data line 12 and pixel electrode of the pixel capacitor 15 respectively. The pixel electrode and liquid crystal form the pixel capacitor 15 with the common electrode of the opposite substrate. The drain of the pixel transistor 13 is connected to one end of the storage capacitor 14, while the other end of the storage capacitor 14 is connected to the storage capacitor line 16.

The pixel matrix 10 is divided into a plurality of pixel regions 10-1 and 10-2 in parallel with the gate lines. In FIG. 1, an example wherein the pixel region is divided into two areas is illustrated for ease of explanation. The present invention is not limited to the illustrated case. The number of the divided area is not limited if the number is an integer more than one.

As shown in FIG. 1, each pixel region has respective k pixel rows. The pixel matrix has 2k pixel rows as a whole. Plural pixels which are belongs to a common pixel column running in two pixel regions 10-1 and 10-2 are connected in common to the same data line 12.

FIG. 2 is a timing chart showing an example of the operation of the liquid crystal display device according to the present embodiment. Operation timing for writing signals in a vertical period (frame period) Tf wherein the liquid crystal display device displays video signals of one screen is shown in FIG. 2. In FIG. 2, Dj denotes the potential of the data line 12 of the j pixel column G1 through G2*k* denote the potentials of the gate lines in 1 to 2k pixel rows. P1, j through P2*k*, j denotes respective potentials of the pixel electrodes in 1 to 2k pixel rows of the j pixel column. In wave-forms showing various voltages, a horizontal broken line denotes the potential Vcom on the common electrode. In the timing chart of FIG. 2, the voltage Dj on the data line (video signal voltage) is illustrated as 9 wave-forms (thus, 18 horizontal periods of time) in the vertical period (frame period) for simplicity of illustration (one screen consists of a multiplicity of lines). The same is applied to the other timing charts. Now, operation of the present embodiment will be described with reference to FIGS. 1 and 2.

A pulse is firstly applied to a gate line G1 included in the first pixel region in one vertical period Tf, so that the potential of the data line Dj at this time is written into the pixel P1, j and held thereon. Then a pulse is applied to the gate line Gk+1 included in the second pixel region, so that the potential of the data line Dj at this time is written into pixel Pk+1, j and held thereon.

Thereafter, signals are successively written into the first pixel region's pixel row and second pixel region's pixel row and so on, so that signals for one screen can be written into all pixels.

Such an operation enables alternate writing of signals into pixel rows of two pixel regions such as writing of signals into the pixel row of the first pixel region and the pixel row of the second pixel region.

The polarity of the signal voltage of a data line Dj (where j is any one of 1 to m) is alternately changed relative to the common electrode every one horizontal period during which signals of one pixel row are written. As a result, signals having positive and negative polarities will be written into the first and second pixel regions, respectively, in the illustrated vertical period.

During next vertical period, signals having negative and positive polarities are written in the first and second pixel regions respectively by inverting the polarity of the data lines.

In other words, signal having the same polarity are written in all pixels at each pixel region and the polarities of the signals which are written in adjacent pixel regions are different from each other. The polarity of the signal to be written is changed in every vertical period.

Figure 4:
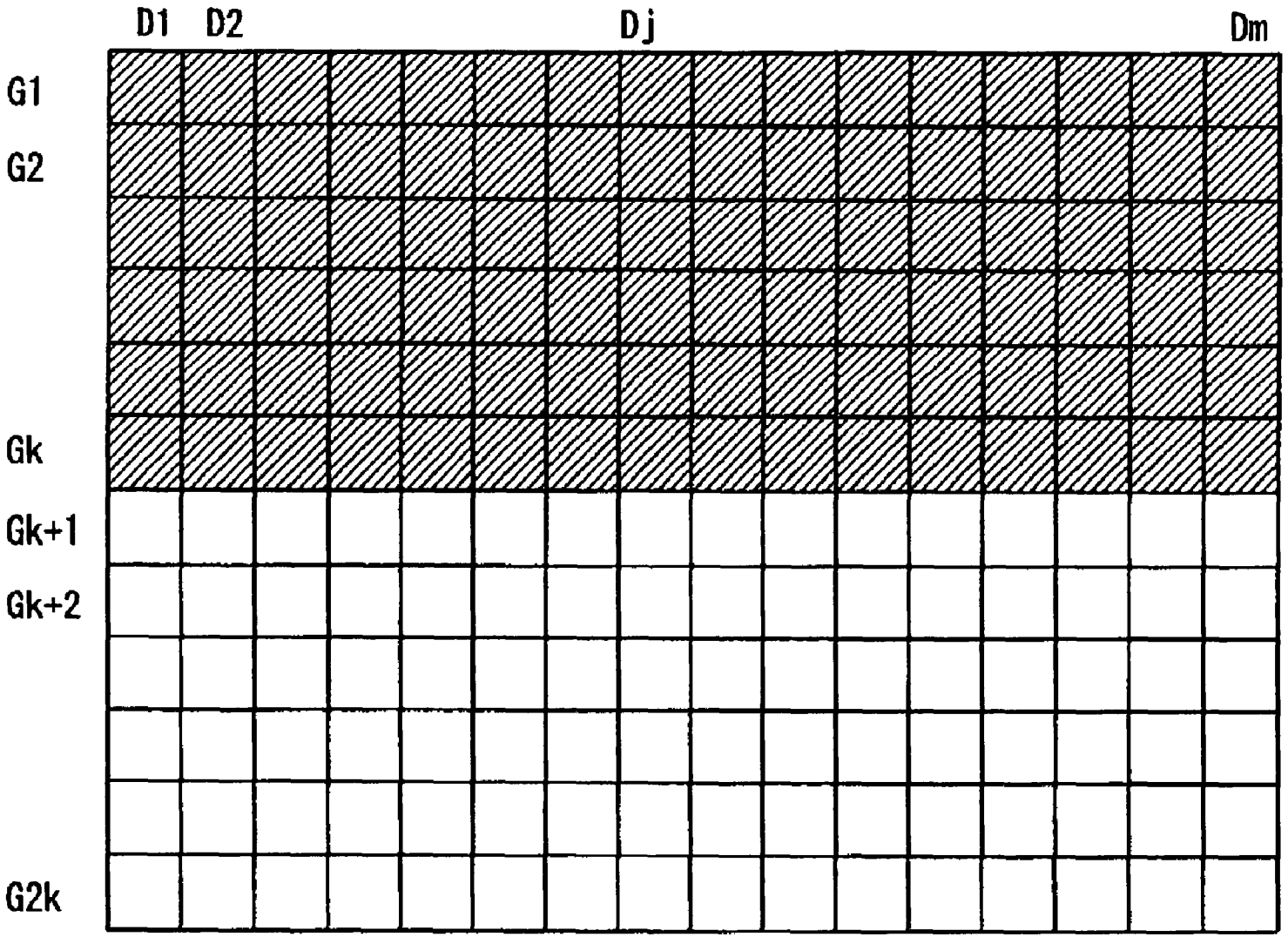
FIG. 4 is a diagram schematically showing the polarity of the video signals which are written into the liquid crystal display device according to the first embodiment of the present invention.
Figure 5:
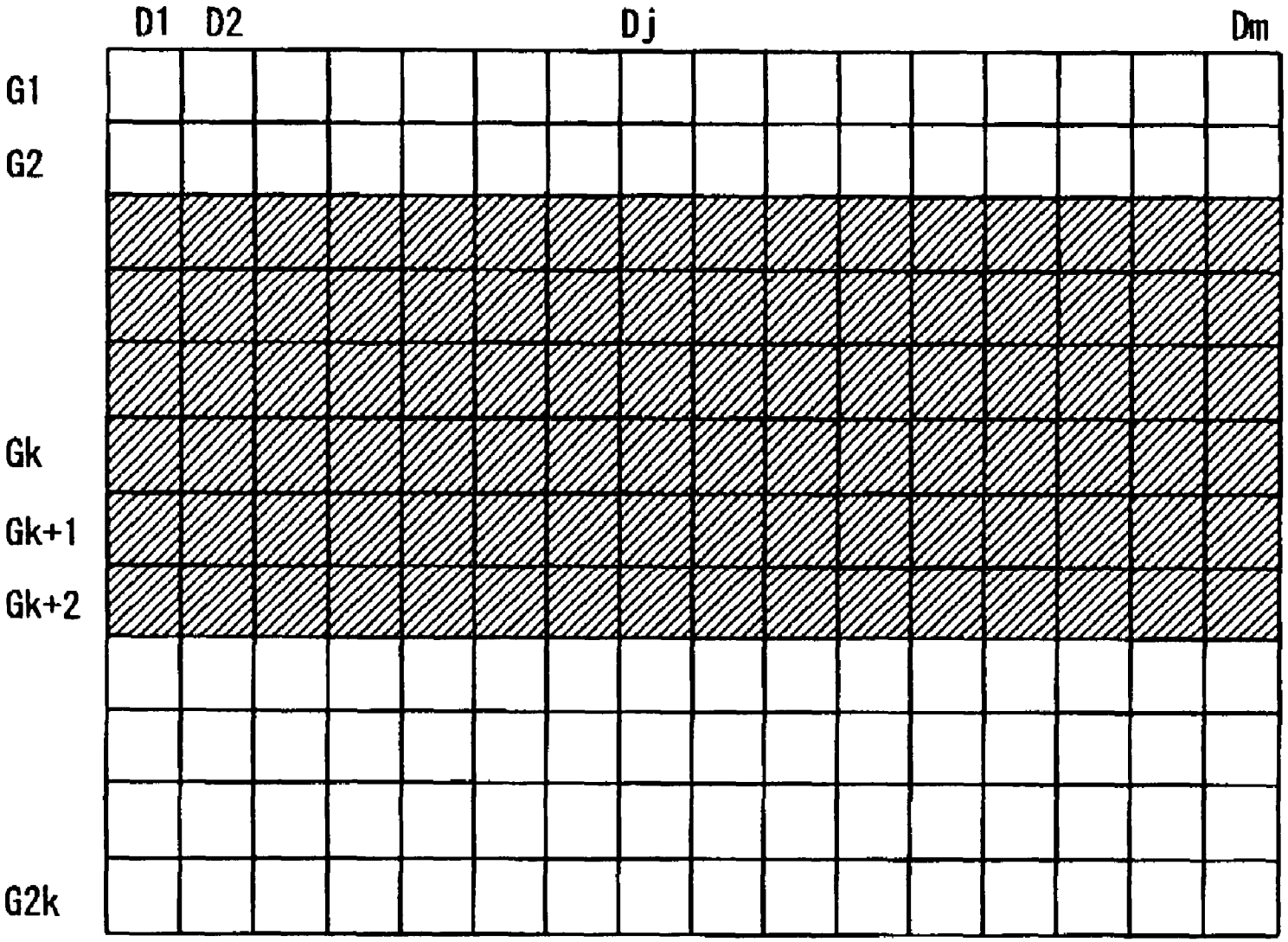
FIG. 5 is a diagram schematically showing the polarity of the video signals which are written into the liquid crystal display device according to the first embodiment of the present invention.
Figure 6:
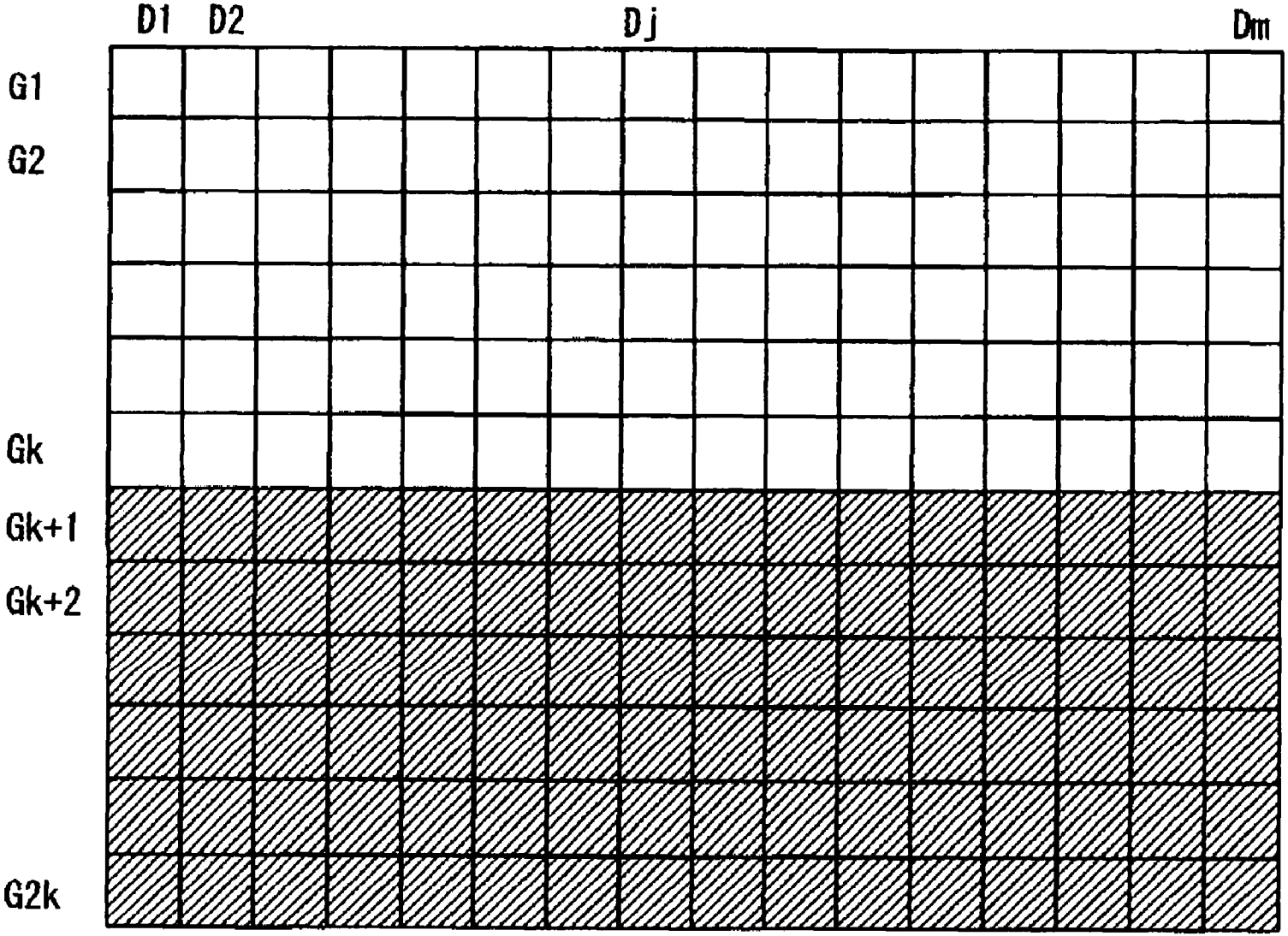
FIG. 6 is a diagram schematically showing the polarity of the video signals which are written into the liquid crystal display device according to the first embodiment of the present invention.

The above-mentioned driving method is visually represented as illustrated in FIGS. 4 to 6. Each of cells which are defined by the data lines D1 through Dm and the gate lines G1 through G2*k* denote a pixel in FIGS. 4 to 6.

FIG. 4 shows the polarity of each pixel immediately before the initiation of writing. Signals having negative polarity are written in portions (pixels) which are represented by hatched lines and signals of having positive polarity are written in the other pixels in the drawing.

FIG. 5 shows the status wherein two pixel rows have been written in each pixel region. Signals having positive polarity have been written in pixel column G1 and G2 at the first pixel region and signals having negative polarity have been written in the pixel columns Gk+1, Gk+2 at second pixel region.

FIG. 6 shows the status after signals have been written in all pixels. Signals having positive and negative polarities have been written in the first and second pixel regions, respectively. As shown in FIGS. 4 through 6, with the above-mentioned operation, a region which includes pixels having the same polarity (e.g. negative polarity) is sequentially shifted and the polarities of all pixels are changed every vertical period.

It is possible to increase the aperture ratio of the pixel by using the driving method which has been described with reference to FIG. 2, 4, to 6 in the liquid crystal display device according to the present embodiment shown in FIG. 1. The reason is as follows:

As schematically shown in FIGS. 4 through 6, the polarity of signals on the adjacent pixels, other than those in pixel rows which the signals have been rewritten is same. Accordingly, the lateral electric field between the pixel electrodes can be reduced, as a result of which, a region wherein disturbance of the orientation of the liquid crystal molecules occurs can be reduced. The region wherein the disturbance of the orientation of the liquid crystal molecules occurs hitherto has been shielded with a metal to prevent the transmission of unwanted light. In the present embodiment, the aperture ratio can be increased due to the fact that the region wherein disturbance of the orientation of the liquid crystal molecules occurs is reduced.

Figure 7:
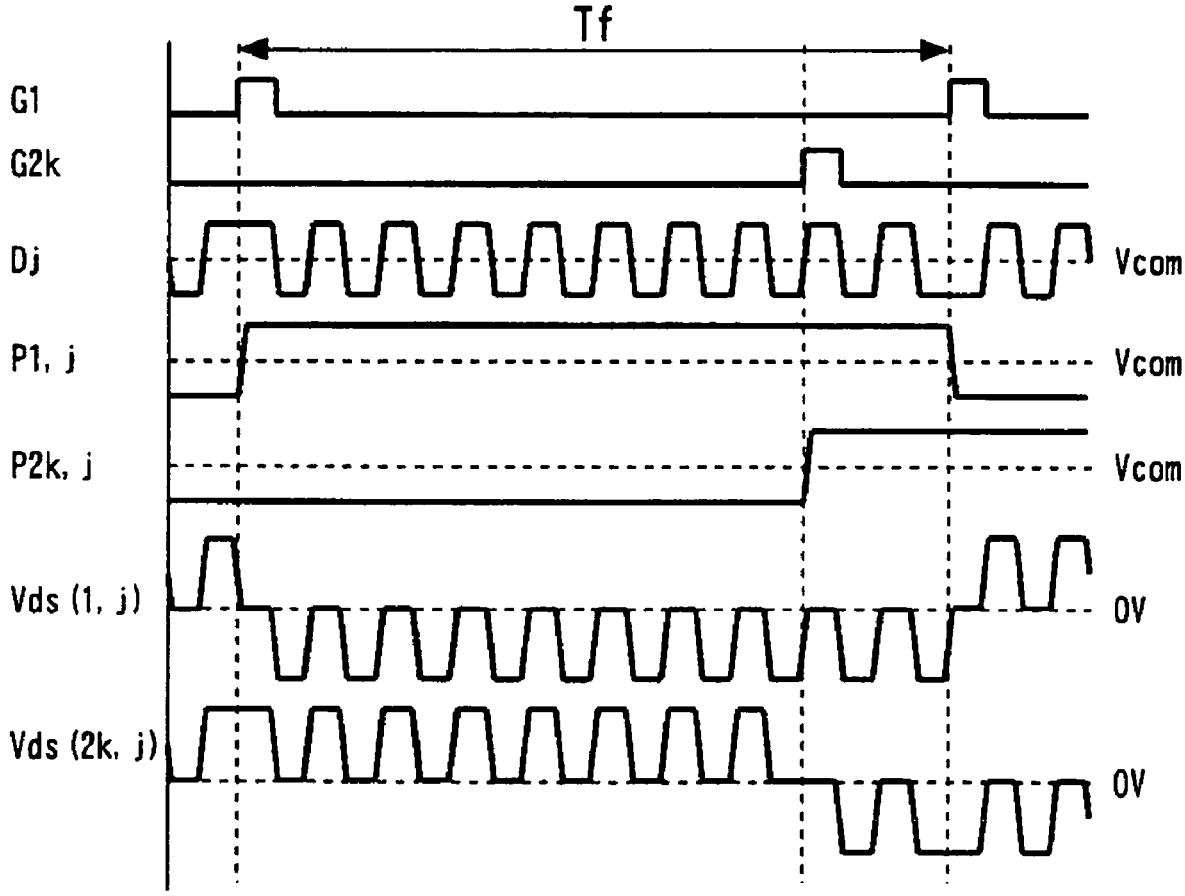
FIG. 7 is a diagram showing the drain-to-source voltage of a pixel transistor of the liquid crystal display device according to the first embodiment of the present invention.

In accordance with the present embodiment, it is possible to reduce the brightness non-uniformity on the screen. The reason will be described with reference to FIG. 7. FIG. 7 shows the drain-to-source voltage Vds of pixel transistors (13 in FIG. 3) located in upper and lower positions of the screen during one vertical period.

Vsd(1, j) denotes the Vds of a transistor in the first row, j-th column pixel and Vsd (2k, j) denotes Vds of a transistor in second row, j-th column. Since the absolute values of the voltages of both are substantially equal, the magnitudes of the leakage currents of the transistors are substantially equal. As a result, the voltage variations of the pixel capacitors due to leakage currents are also substantially equal and hence the change in brightness depending upon the position of the screen is eliminated. The voltage variations ascribable to leakage current become equal in all pixels and flicker can be reduced.

The embodiment has been described by way of a method wherein signals are written on a pixel-row unit basis from the upper side to the lower side of the screen. The present invention is not limited to only such scanning method. For example, similar effects can also be obtained if the signals are written from the lower side to the upper side of the screen.

In the present embodiment, the number of the pixel regions which are divided from the pixel matrix is two, it is of course that the number of the divided pixel regions may be a desired number larger than 2.

Figure 8:
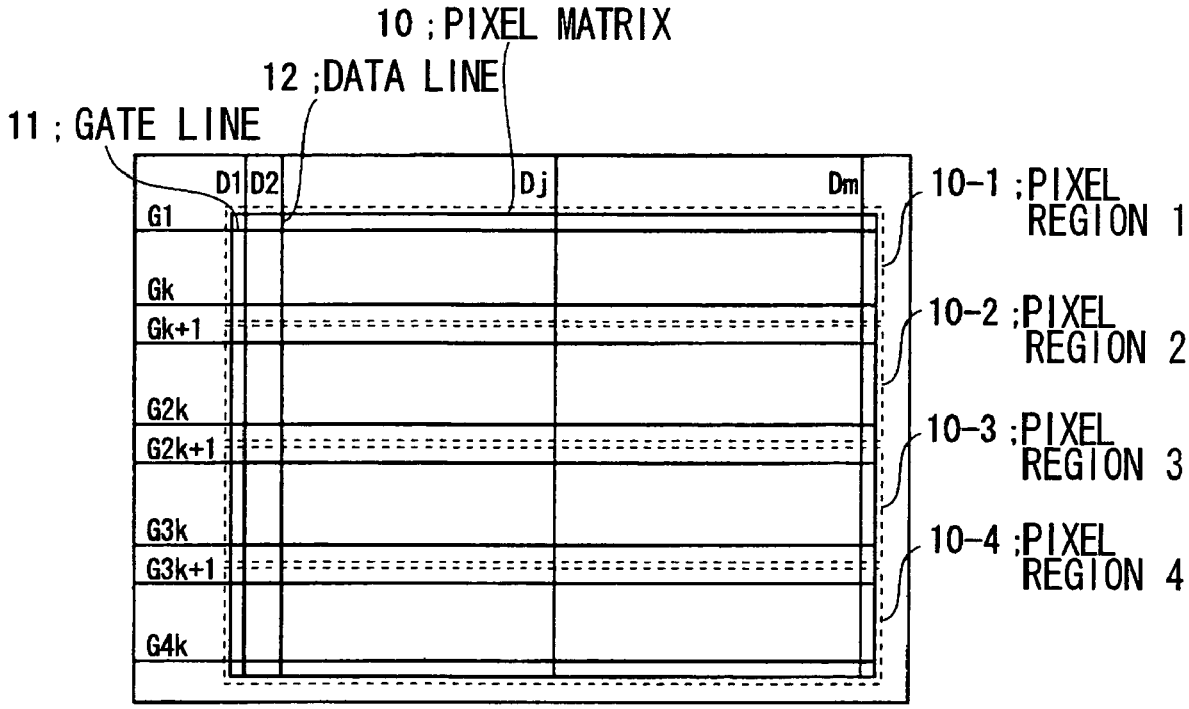
FIG. 8 is a diagram showing the configuration of the liquid crystal display device according to the second embodiment of the present invention.
Figure 9:
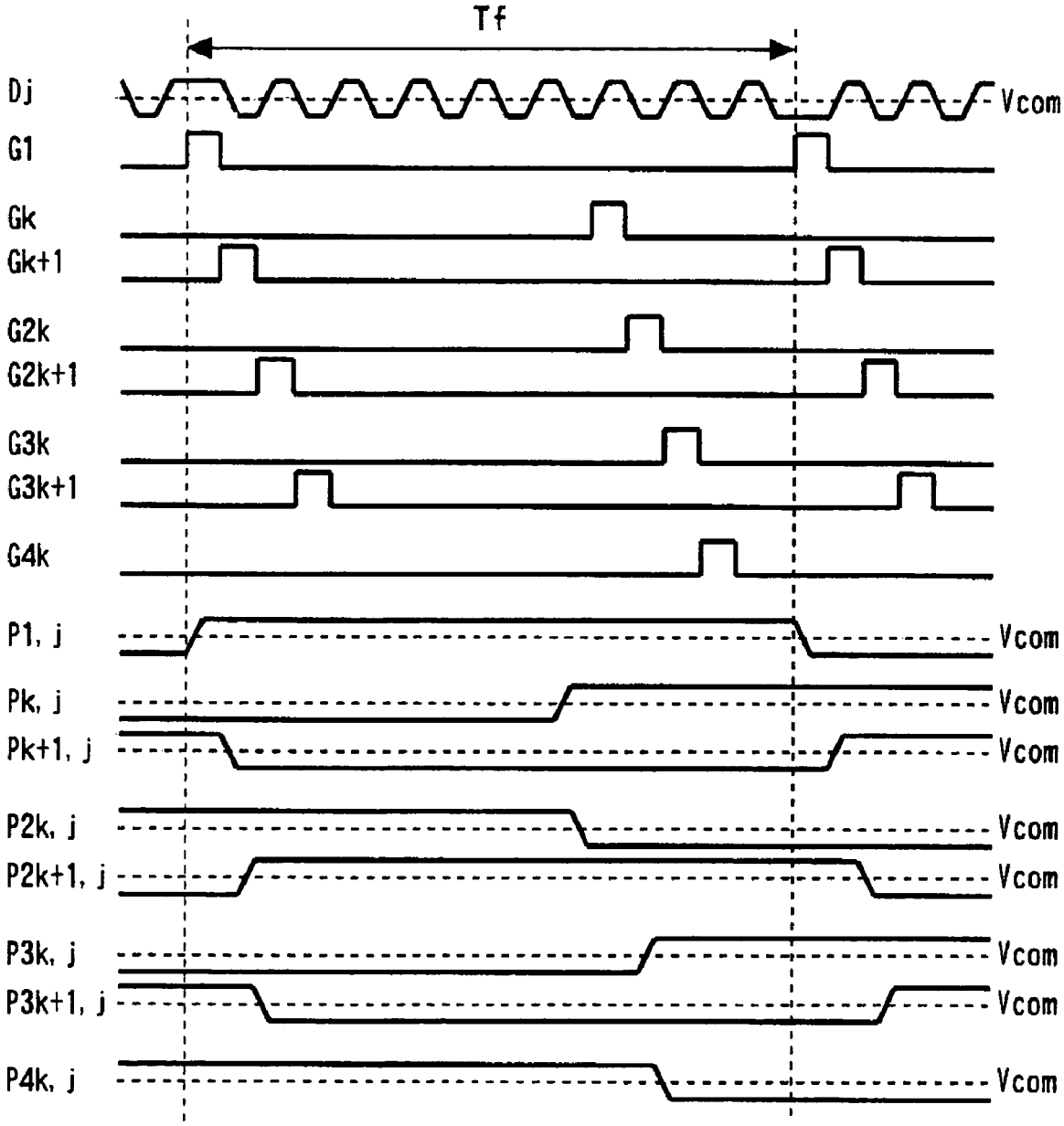
FIG. 9 is a timing chart explaining the operation according to the second embodiment of the present invention.

Another embodiment of the present invention will now be described. An configuration wherein the pixel matrix is divided into 4 is shown in FIG. 8 as an example wherein the pixel matrix is divided into a number larger than 2. In the second embodiment of the present invention, the pixel matrix 10 comprises pixel regions 10-1 through 10-4. FIG. 9 is a timing chart showing the operation of the configuration in FIG. 8. In FIG. 9, Dj denotes the signal voltage of the data lines 12, G1 through Gk, Gk+1 through G2*k*, G2*k*+1 through G3*k*, G3*k*+1 through G4*k* denote voltage wave forms of the gate lines of the first, second, third and fourth pixel regions, respectively. P1, j through Pk, j, Pk+1, j through P2*k*, j, P2*k*+1, j through P3*k*, j, P3K+1, j through P4*k*, j denote the potentials of the pixel electrodes in first to k-th pixel row (first pixel region), k+1 to 2K-th pixel rows (second pixel region), 2K+1 to 3k-th pixel rows (third pixel region9, and 3k+1 to 4k-th pixel rows (fourth pixel region), respectively. Horizontal broken lines in the wave-form representative of each voltage denote a common electrode potential Vcom.

During the vertical period Tf, an application of a pulse to a gate line G1 included in the first pixel region causes the potential of the data line Dj at this time to be written into a pixel P1, j and held therein. Then, an application of a pulse on the gate line Gk+1 included in the second pixel region causes the potential of the data line Dj at this time to be written into a pixel Pk+1, j and held therein. Then an application of a pulse to a gate line G2*k*+1 included in the third pixel region causes the potential of the data line Dj at this time to be written into a pixel P2*k*+1, j and held therein. Then, an application of a pulse on the gate line G3*k*+1 included in the fourth pixel region causes the potential of the data line Pj at this time to be written into a pixel P2*k*+1, j and held therein.

Sequential writing of signals in order of the first, second, third and fourth pixel region's pixel rows thereafter enables the signals of one screen to be written into all pixels. Such an operation will cause signals to be alternately written into pixel rows of four pixel regions, such as the pixel rows of the first, second, third and fourth pixel regions.

The polarity of the signal voltage of Dj which is a desired data line is alternately changed relative to common electrode voltage Vcom every one horizontal period of time which is taken to write signals of one pixel row. Therefore, during the illustrated vertical period, signals having positive polarity will be written into first and third pixel regions and signals having negative polarity will be written into second and fourth pixel regions.

During next vertical period, the polarity of the data line is inverted, so that signals having negative polarity area written into the first and third pixel regions and signals having positive polarity are written into the second and fourth pixel regions.

In other words, signals having the same polarity are written into all pixels of each pixel region and signals having different polarities are written into the adjacent pixel regions. The polarity of signals to be written is changed every vertical period.

More distinct effect can be achieved by the present invention if the pixel matrix is divided into an even number of pixel regions and the numbers of pixel columns included in respective pixel regions are equal to each other. The reason resides in that the pixel regions to which the signals are written can be selected so that the polarity of the video signal is certainly changed every one horizontal period.

In the present embodiment, one vertical period during which signals of one screen are written may be 8.3 ms or less (vertical synchronization signal frequency of 120 Hz or higher). In this case, the flicker reduction effect becomes larger. The reason resides in that by making one vertical period 8.3 ms or less, the period which is taken to write a signal into one pixel becomes shorter, the variations of the voltage across the pixel capacitor due to the leakage current become smaller and the frame frequency is increased, so that screen flicker is hard to be perceived by human eyes.

Figure 10:
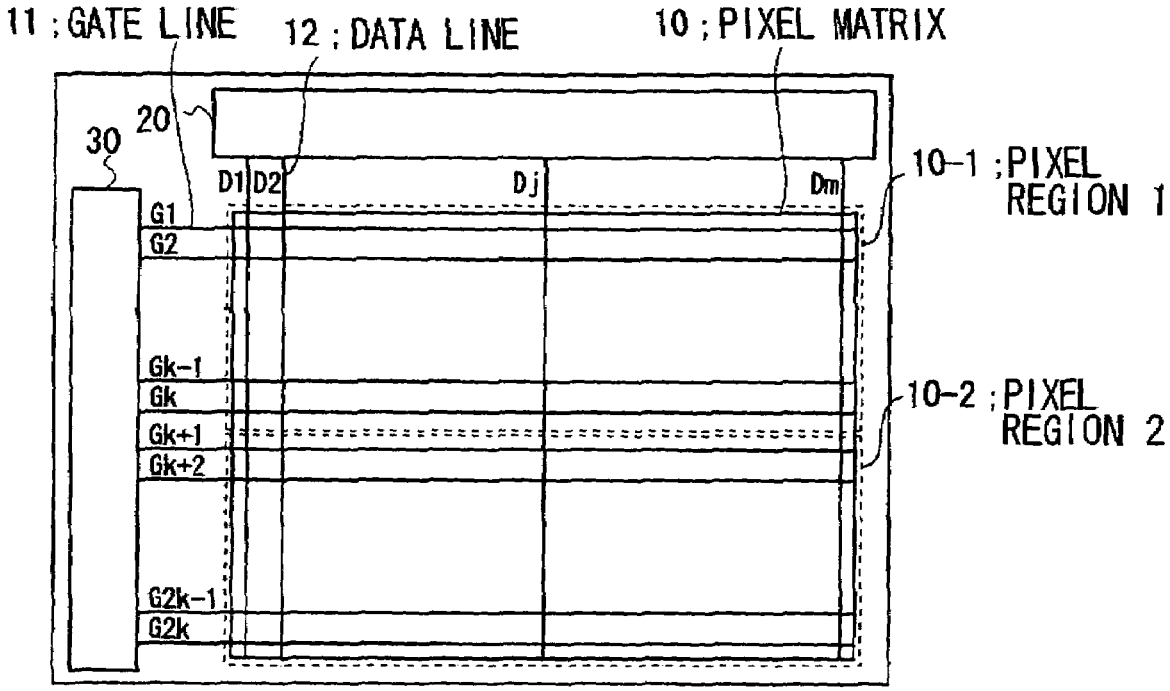
FIG. 10 is a diagram showing the configuration of the liquid crystal display device according to the third embodiment of the present invention.

A drive circuit for practicing the above-mentioned driving method will be described. FIG. 10 shows the configuration of the liquid crystal display device of the third embodiment of the present invention. The liquid crystal display device comprises a pixel matrix 10 including pixels each comprising a pixel transistor 13, pixel capacitor 15, and storage capacitor 14 as shown in FIG. 3. Each pixel is disposed in each of intersections of the data lines denoted as D1 through Dm with the gate lines denoted as G1 through G2*k*. A liquid crystal is sandwiched between a matrix substrate on which the pixel matrix is formed and an opposite substrate (not shown) on which a common electrode common to the pixel electrodes of pixels is provided. The pixel matrix is divided into plurality of pixel regions which are in parallel with the gate lines. In an example shown in FIG. 10, the pixel matrix is divided into two pixel regions 10-1 and 10-2. It is of course that the pixel matrix may be divided to a desired number of pixel regions if the number is an integer larger than 1. The configuration of the pixel matrix in FIG. 10 is identical with that shown in FIG. 1.

Each pixel region has k number of pixel rows. The whole of the pixel matrix 10 has 2k number of pixel rows. The pixels which belong to a common pixel column in two pixel regions 10-1 and 10-2 are connected to the same data line.

In the present embodiment, a data driver circuit 20 for driving the data line 12 and a gate driver circuit 30 for driving the gate line 11 are formed on the matrix substrate. The data driver circuit 20 and the gate driver circuit 30 may be made of TFTs (this film transistors) which are formed on the matrix substrate simultaneously with the pixel transistors (TFTs) of the pixel matrix 10.

Figure 11:
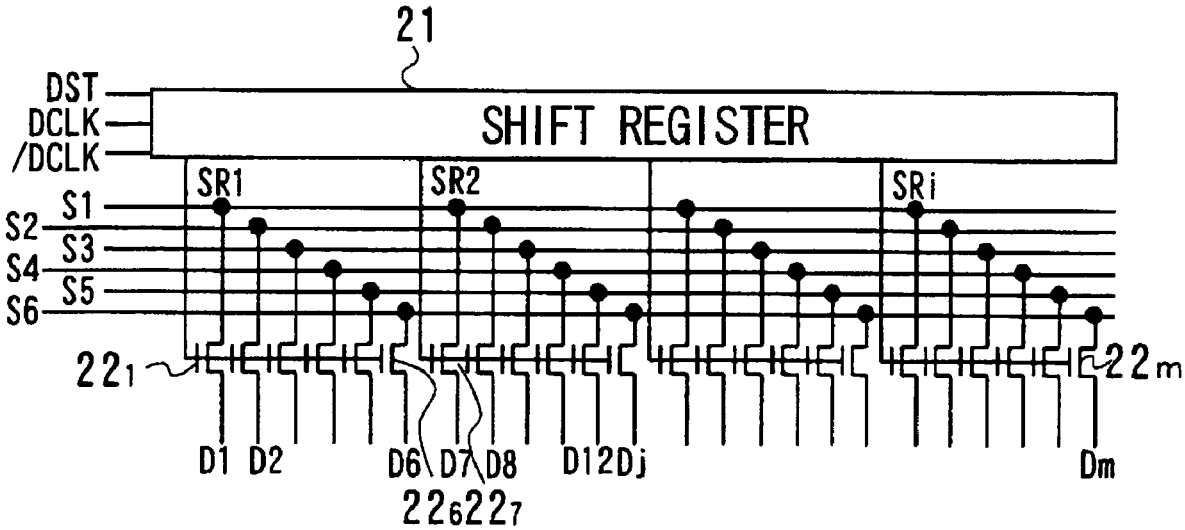
FIG. 11 is a diagram showing an exemplary configuration of the data driver circuit shown in FIG. 10.
Figure 12:
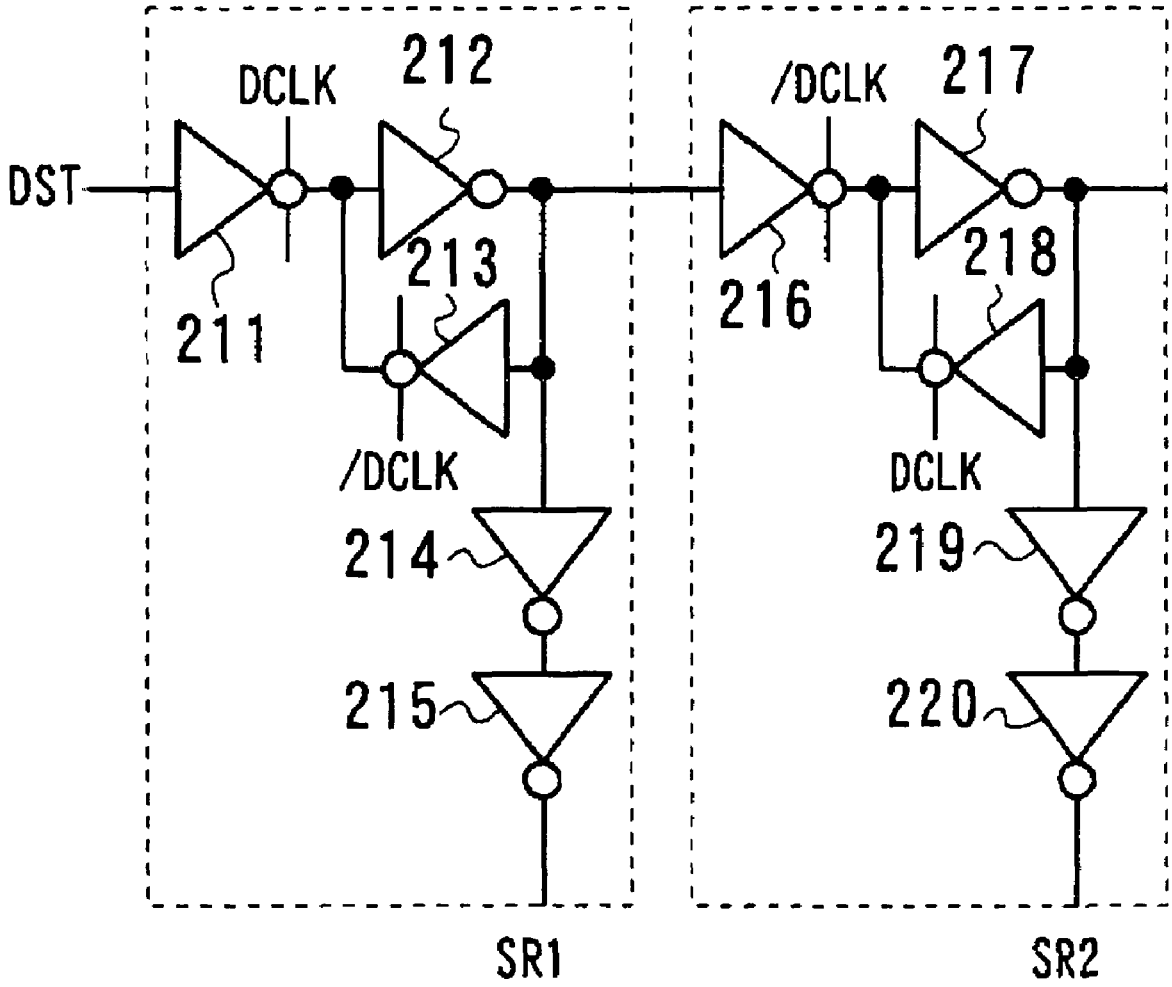
FIG. 12 is a diagram showing an example of the shift register which forms the data driver circuit shown in FIG. 11.

FIG. 11 shows an exemplary configuration of the data driver circuit 20 in FIG. 10. The circuit 20 comprises a shift register 21 and a switch array $\mathbf{22}_1$ through 22*m*. The shift register 21 may be composed by a static type shift register as shown in FIG. 12. Although an example wherein six video signals S1 through S6 are simultaneously supplied to the pixel matrix is illustrated in FIG. 10, the number of the video signals may be a desired number if it is an integer which is one or more.

The switch array is configured so that six switches are simultaneously controlled by a signal from the shift register 21. The switches $\mathbf{22}_1$ through $\mathbf{22}_6$ are turned on when a signal SR1 from the shift register 21 are at a high level for outputting video signals S1 through S6 to the data lines D1 through D6, respectively. Subsequently, when SR2 is at a high level, the switches which are connected to data lines D7 through D12 are turned on to output the video signals S1 through S6 to the data line D7 through D12, respectively. In such a manner, the video signals S1 through S6 are sequentially sampled to the data lines.

Referring now to FIG. 12, the shift register 21 shown in FIG. 11 comprises a plurality of D-latches. The latch at the first stage includes a clocked inverter 211 which is on/off controlled in response to a clock signal DCLK and a flip-flop composed by an inverter 212 and a clocked inverter 213 which is on/off controlled in response to a clock signal /DCLK which is complementary to the clock signal DCLK and which has an input connected to an output of the clocked inverter 212 and has an output connected to an input of the clocked inverter 212. The output signal of the inverter 213 is output via an inverter 214 and an inverter 215 (inverting driver circuit) as a signal SRI. The latch at the second stage which receives an output from the latch at the first stage is identical in structure with the latch at the first stage. That is, the latch at the second stage includes a clocked inverter 216 which is on/off controlled responsive to a clock signal/DCLK and a flip-flop composed by an inverter 217 and a clocked inverter 218 which is on/off controlled responsive to a clock signal DCLK. The output signal of the inverter 217 is output via an inverter 219 and an inverter 220 (reversed type driver circuit) as a signal SR2. A signal which is complementary to the clock signal supplied to the D-latch at the first stage is supplied as a clock signal to the D-latch at the second stage. The latch at the first stage outputs a start signal DST which is input when the clock signal DCLK is at a high level. The clocked inverter 211 is turned off when the clock signal DCLK is at a low level, so that a feed-back loop made up of the inverter 212 and the clocked inverter 213 is established to compose a flip-flop for holding data. The latch at the second stage conducts an operation which is reversal to that of the latch at the first stage relating to the clock signal DCLK. This causes the signal DCT to be driven by the clock signal DCLK and to propagate through the shift register 21.

Figure 13:
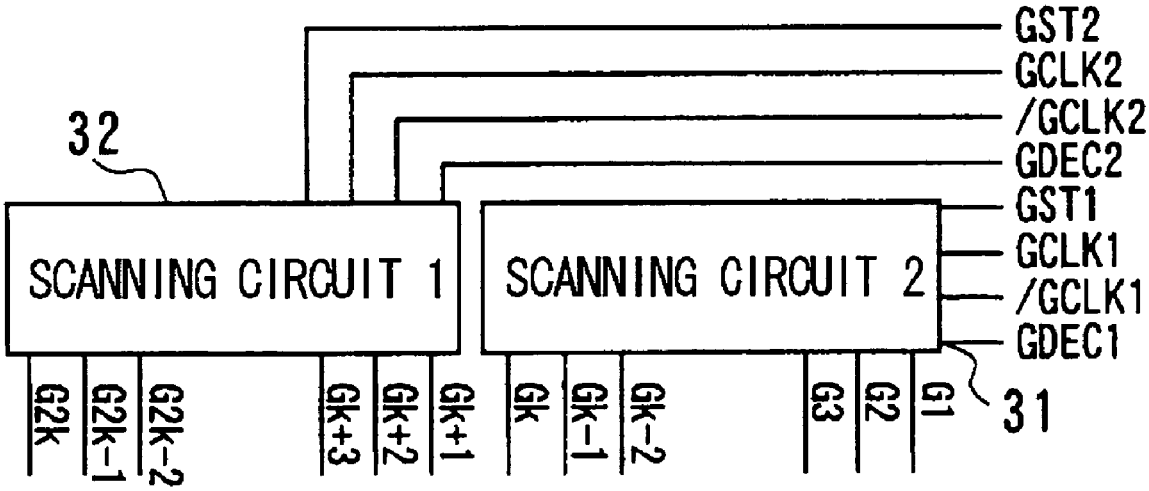
FIG. 13 is a diagram showing the configuration of the gate driver circuit shown in FIG. 10.

FIG. 13 shows an exemplary configuration of the gate driver circuit 30 shown in FIG. 10. Referring to FIG. 13, the gate driver circuit 30 comprises two scanning circuits 31 and 32 corresponding to two divided pixel regions respectively.

Figure 14:
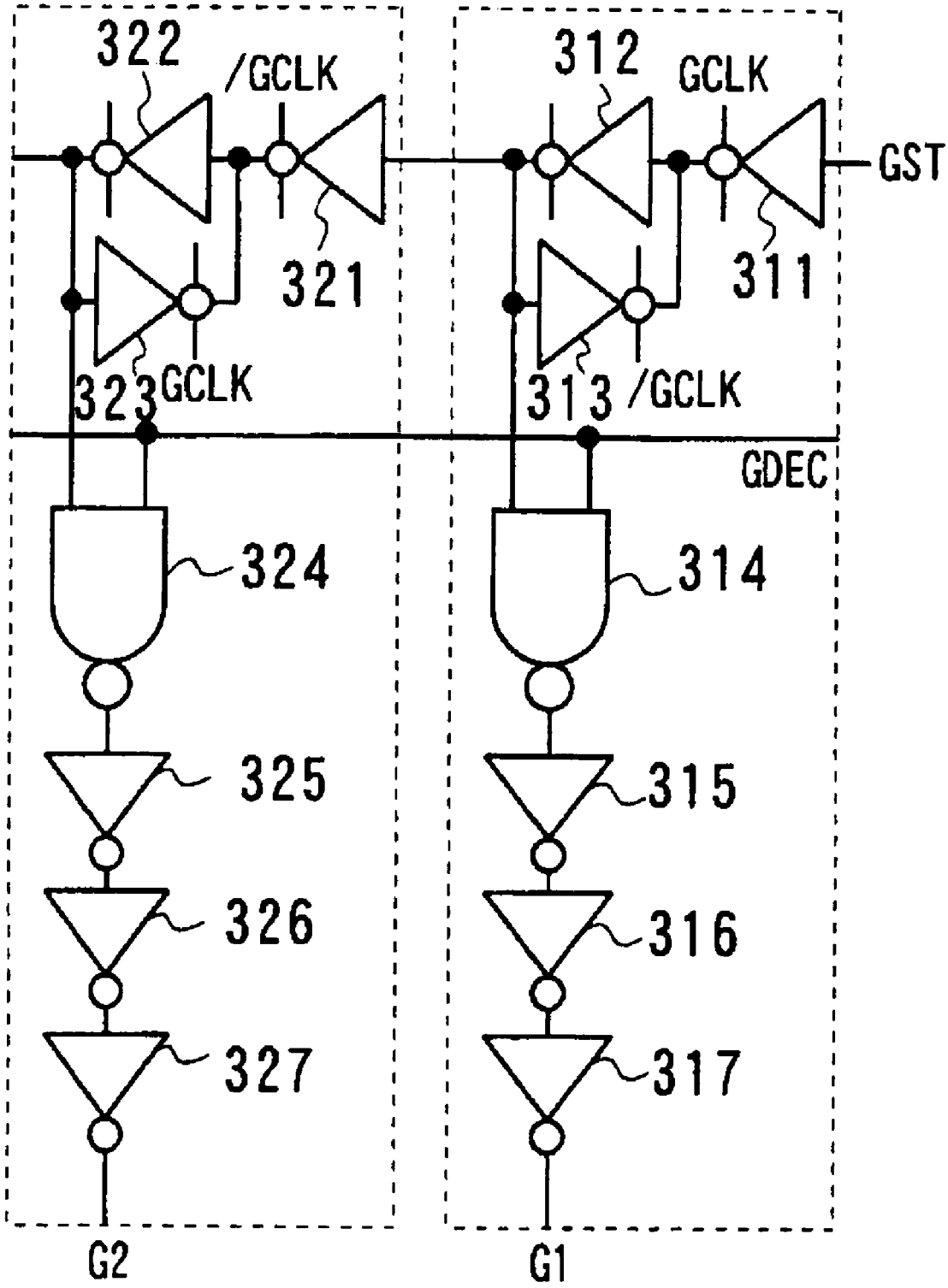
FIG. 14 is a diagram showing an example of the shift register which forms the gate driver circuit shown in FIG. 13.

FIG. 14 shows an exemplary configuration of each scanning circuit. Referring now to FIG. 14, each scanning circuit comprises a D-latch at the first stage which forms a static shift register which shifts a start signal GST responsive to a clock signal (the latch comprising a clocked inverter 311 which is on/off controlled responsive to a clock signal GCLK1, an inverter 312 and a clocked inverter 313 which is on/off controlled responsive to a clock signal/GCLK1), a NAND gate 314 which conducts a NAND operation between an output of the D-latch and a decode signal GDEC signal and inverter array 315 through 317. A gate signal G1 (scanning signal) is output from the inverter 317 (inverting driver circuit). A circuit which generates and outputs a gate signal G2 includes a D-latch at the second stage (comprising a clocked inverter 321 which is on/off controlled responsive to the clock signal/GCLK1, an inverter 322 and a clocked inverter 323 which is on/off controlled responsive to the clock signal GCLK1), a NAND gate 324 which conducts a NAND operation between an output of the D-latch and the decode signal GDEC signal and an inverter array 325 through 327. In the scanning circuits 31 and 32, the decode signals GDEC are denoted by GDEC1 and GDEC2, respectively, and the start signals GST are denoted by GST1 and GST2, respectively, and the clock signals GCLK are denoted by GCLK1 and GCLK2, respectively. A circuit which generates other gate signals G3, . . . , Gk is similarly configured. Any other combination may be used if the circuit is capable of obtaining a logical product between an output of the shift register and an external decode signal.

The gate driver circuit 30 may include a decode circuit which outputs a pulse signal to a desired gate line at desired timing in response to a signal from a device which is external of the display device. In this case, it is not necessary to provide a gate driver circuit comprising a decode circuit for each of the pixel regions.

In the above-mentioned embodiment, each shift register which is used for the data driver circuit 20 and gate driver circuit 30 shifts in only one direction. A shift register which is capable of changing the shift direction bidirectionally (e.g. left shift and right shift) may be used.

The data driver circuit 20 may include an amplifier for amplifying an input video signal or a buffer circuit. The data driver circuit 20 may have a D/A converter receiving a video signal as a digital signal and converting the digital signal into an analog signal. In this case, the D/A converter circuit may be composed by TFTs formed on the matrix substrate.

Figure 17:
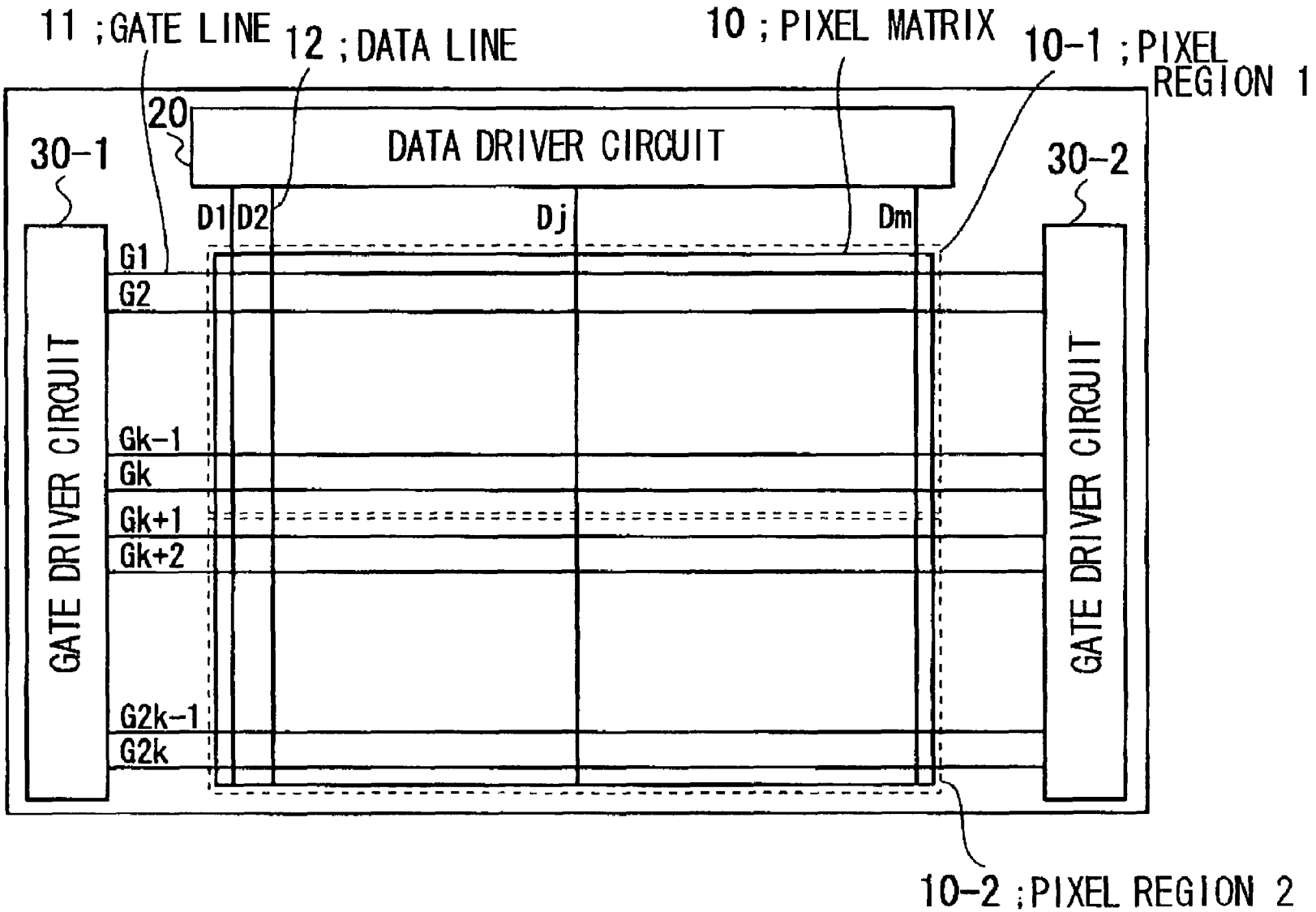
FIG. 17 is a diagram showing the configuration of the liquid crystal display device according to the fourth embodiment of the present invention.

In the embodiment shown in FIG. 10, the gate driver circuit 30 is disposed on only one side of the pixel matrix. The present invention is limited to such a configuration. In a fourth embodiment, the gate driver circuits 30-1 and 30-2 may be disposed on the both sides of the pixel matrix as shown in FIG. 17.

Figure 18:
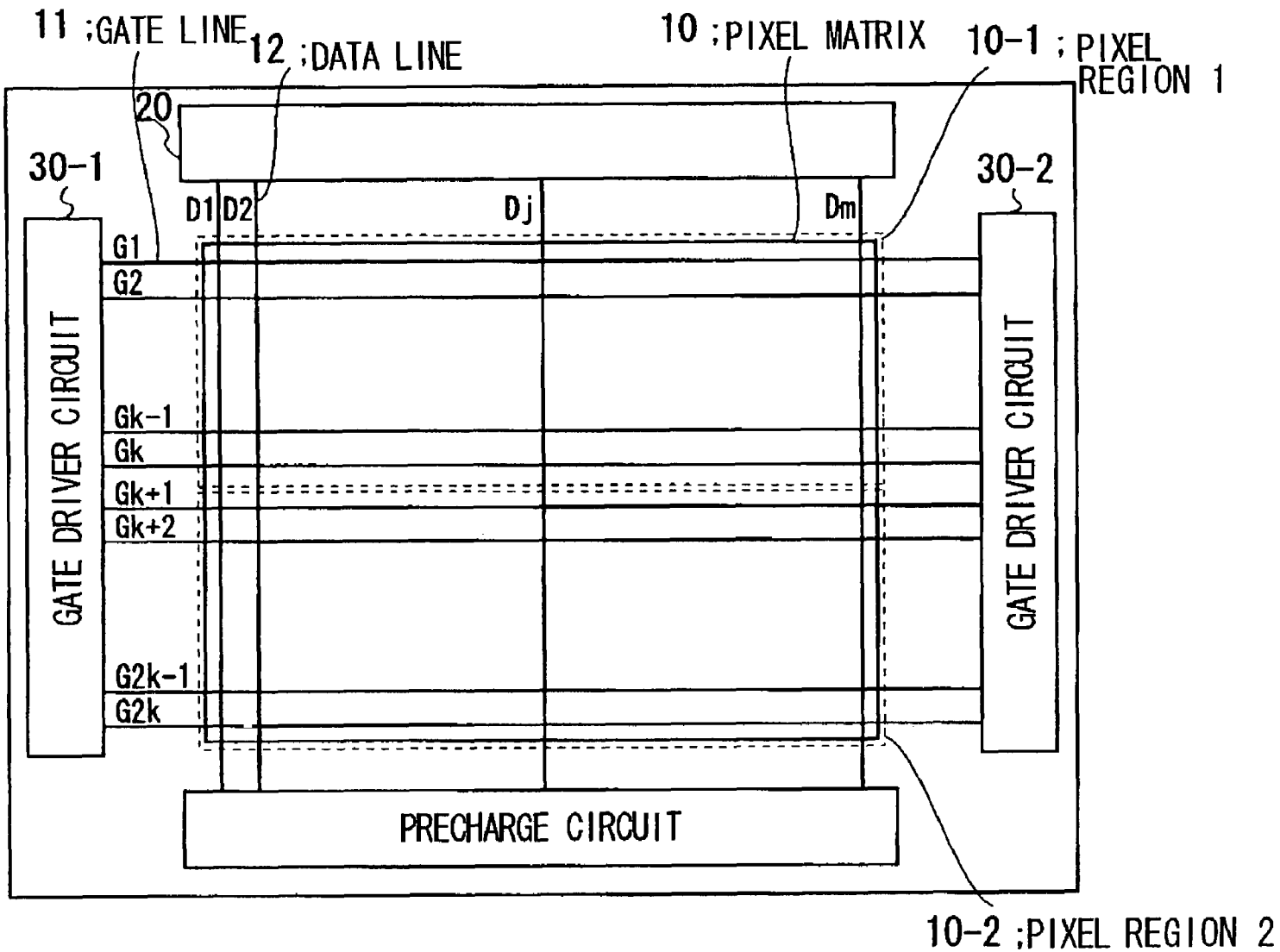
FIG. 18 is a diagram showing the configuration of the liquid crystal display device according to the fifth embodiment of the present invention.
Figure 19:
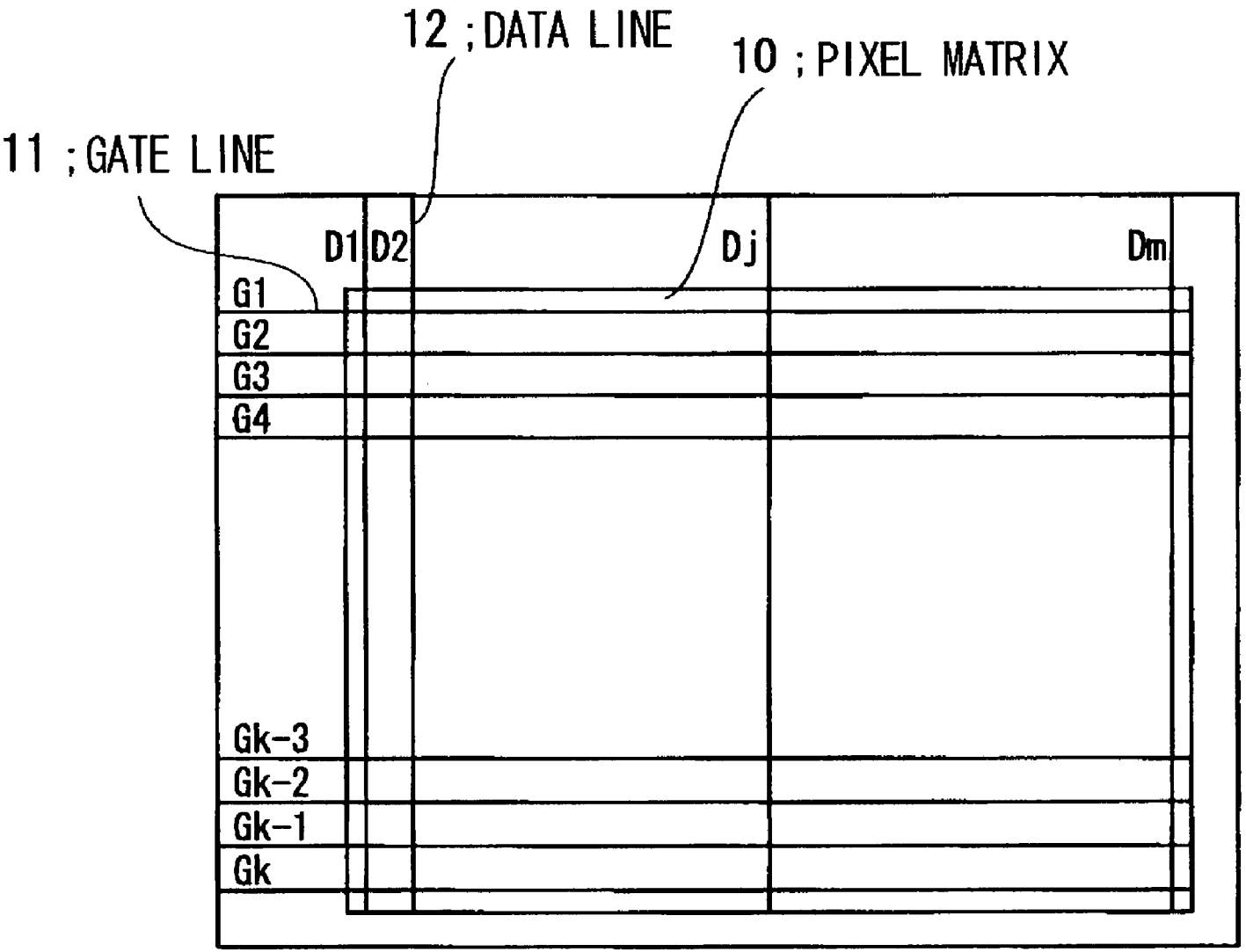
FIG. 19 PRIOR ART
FIG. 19 is a diagram showing the configuration of the prior art liquid crystal display device.
Figure 20:
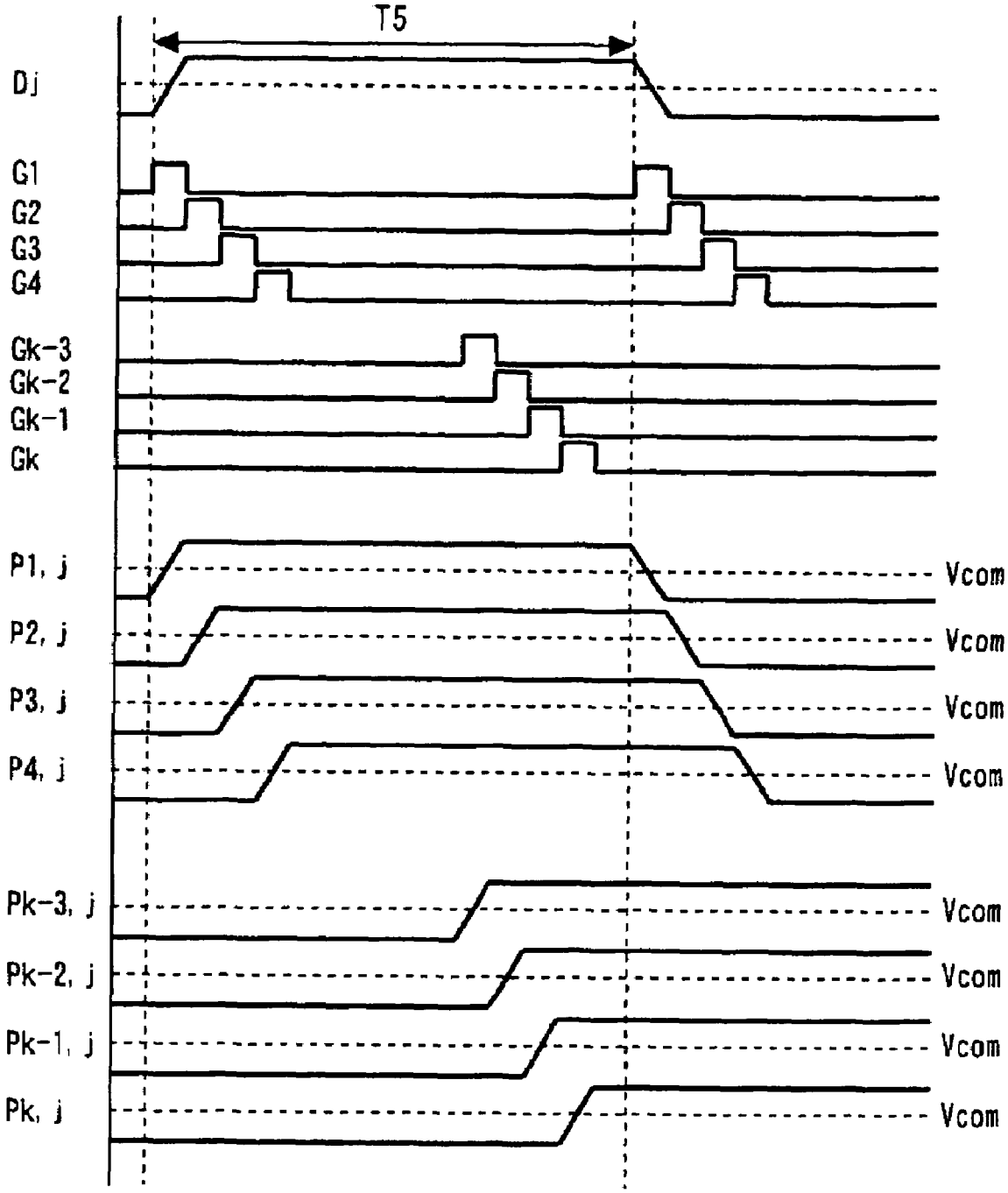
FIG . 20 PRIOR ART
FIG. 20 is a timing chart explaining the operation of the prior art liquid crystal display device.
Figure 21:
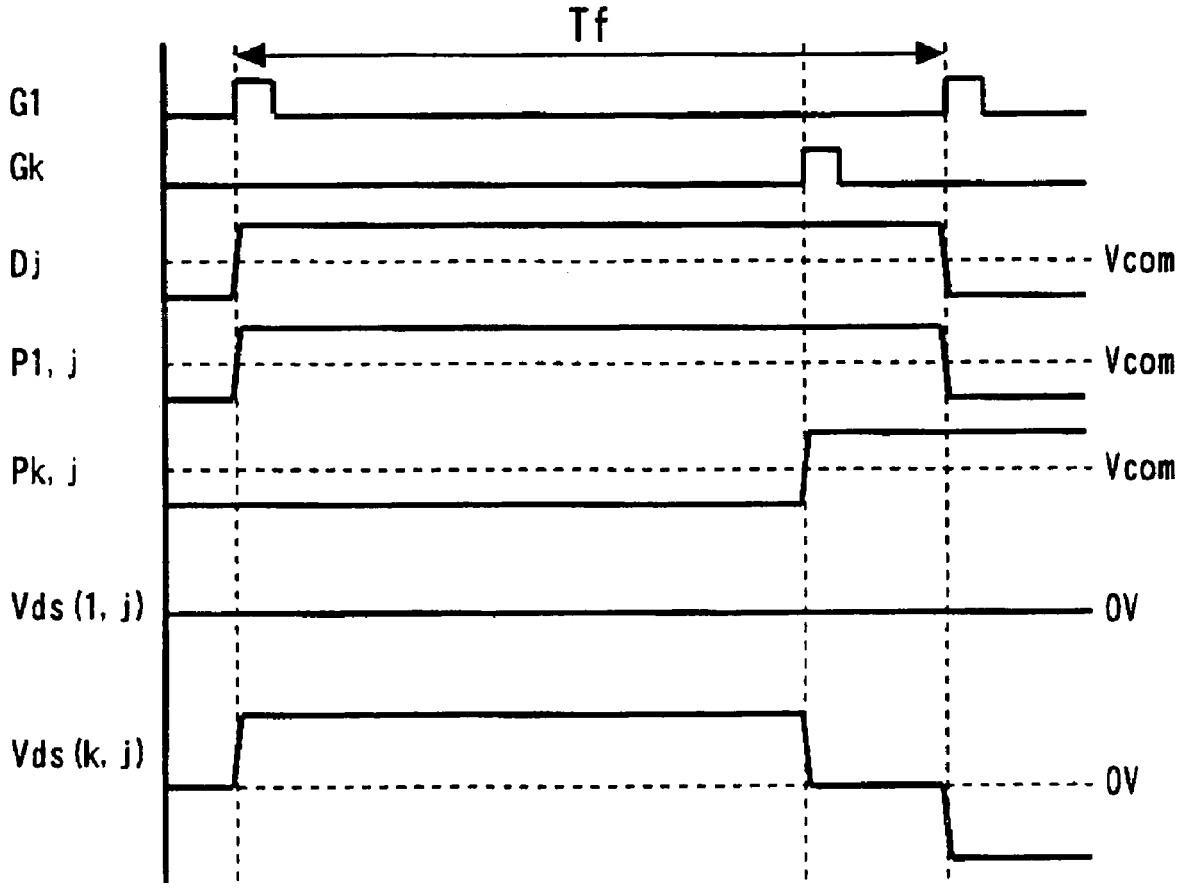
FIG . 21 PRIOR ART
FIG. 21 is a graph showing the drain-to-source voltage of the pixel transistor of the prior art liquid crystal display device.

A fifth embodiment of the present invention will now be described. In the fifth embodiment, a pre-charge circuit 40 which is capable of performing preliminarily charging/discharge of the data line 11 (all data lines) of the pixel matrix to a desired voltage every one horizontal period is provided as shown in FIG. 18.

An operation for writing video signals into the liquid crystal display device of the present invention is similar to that in the first embodiment.

Figure 15:
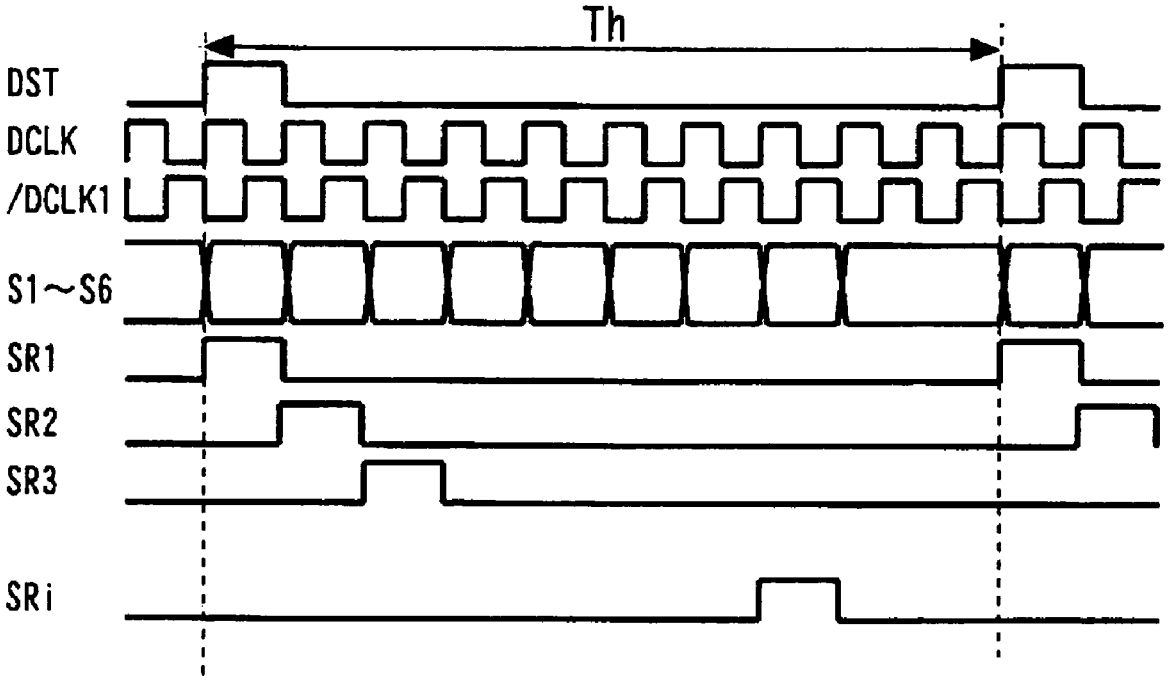
FIG. 15 is a timing chart explaining the operation of the data driver circuit according to the third embodiment of the present invention.

The operation of the data driver circuit 20 will now be described. FIG. 15 is a timing chart showing an example of the operation of the data driver circuit 20 which is shown in FIGS. 10 and 11. In FIG. 15, a period Th denotes one horizontal period during which signals are written into one pixel row (line) of the liquid crystal display device. DST denotes a start signal which is supplied to a transfer terminal of the shift register 20. DCLK and /DCLK denote complementary clock signals. S1 through S6 denote video signals input to the data driver circuit. SR1 through SRi denote output signals of the shift register 21. When a pulse is supplied as a start signal DST, pulse signals SR1, SR2, SR3, . . . . SRi are sequentially output from the shift register 21 in synchronization with the clock signal DCLK. The video signals which are supplied to S1 through S6 are sampled to the data line by turning on or off of every six switches of the switch array 22 in response to the output pulses SR1, SR2, SR3, . . . SRi. By repeating this operation i-times, video signals are sequentially sampled on all data lines.

Figure 16:
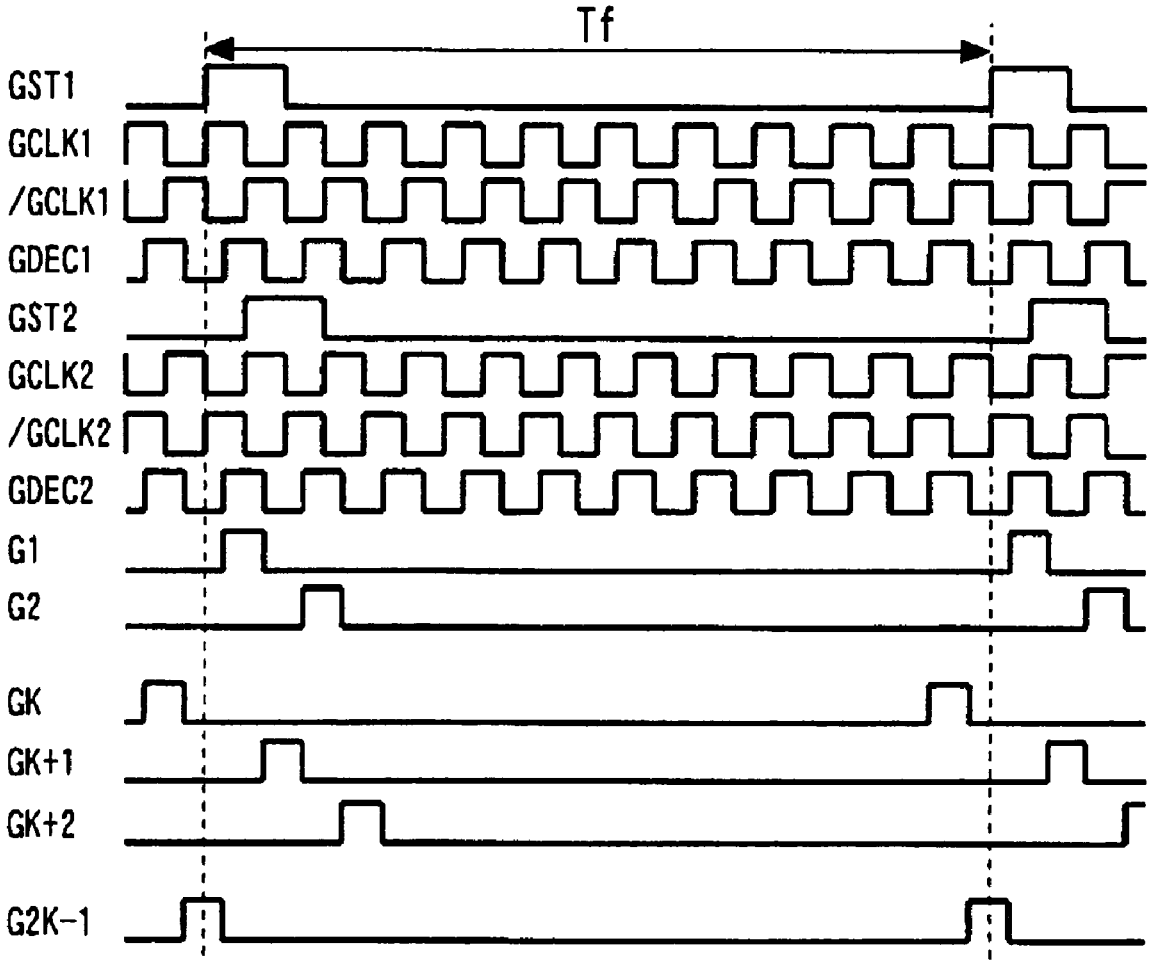
FIG. 16 is a timing chart showing the operation of the gate driver circuit according to the third embodiment of the present invention.

Now, the operation of the gate driver circuit 30 will now be described. FIG. 16 is a timing chart showing an exemplary operation of the gate driver circuit 30 which is shown in FIGS. 12 and 13. A period Th denotes one vertical period. GST1 and GST2 denote start signals of the first and second scanning circuits 31 and 32 which correspond to the first and second pixel regions 10-1 and 10-2, respectively. GCLK1 and /GCLK1 denote complementary clock signals of the first scanning circuit 31. GCLK2 and /GCLK2 denote complementary clock signals of the second scanning circuit 32. GDEC1 and CDEC2 denote decode signals for shaping the wave-form output from the shift registers in the first and second scanning circuits 31 and 32, respectively.

The periods of the clock signals GCLK1 and GCLK2 are equal to the periods 2Th which is equal to two horizontal periods of time. The clock signal GCLK1 is out of phase with respect to the clock signal GCLK2 by one horizontal period Th. The start signal GCT1 and GCT2 are supplied to the gate driver circuit 30 while they are out of phase by one horizontal period Th.

When the signal which is shown in FIG. 15 is supplied to the gate driver circuit 30, as the outputs of the shift registers (D-latch file shown in FIG. 14) of the first and second scanning circuits 31 and 32, pulses are output in order in a period of 2Th of 2 horizontal period. Logical products between this output signals and the decode signals GDEC1 and GDEC2 are supplied to the gate lines 11 as the outputs of the first and second scanning circuits 31 and 32. Since the clock signals GCLK1 and GCLK2 of the first and second scanning circuits 31 and 32 are shifted to each other by one horizontal period Th and the output pulses from the first and second scanning circuits 31 and 32 are shaped to pulses having a time length which is substantially equal to Th by the decode signals GDEC1 and GDEC2, pulses are alternately output from the first and second scanning circuits 31 and 32 with a period of one horizontal period Th as a result (i.e., pulse outputs of G1 and Gk+1, then pulse outputs of G2 and Gk+2, . . . , and then pulse outputs of Gk and G2*k*+1).

The operation of the data driver circuit 20 and the gate driver circuit 30 enables such an operation that video signals are supplied to all data lines every one horizontal period, that the signals supplied to the data lines for each one pixel row of the divided pixel region are written into pixels and that the pixel region to which video signals are written is changed each horizontal period.

In the present embodiment, at least one of the peripheral circuits, such as the data driver circuit, gate driver circuit or precharge circuit may be made of TFTs (thin film transistors) formed on a TFT substrate which are provided with pixel transistors. In this case, polycrystalline (polysilicon) TFTs are preferably used. The polycrystalline TFTs have a high field effect mobility and are preferable for manufacturing peripheral circuits such as drive circuit on a TFT substrate and enable high speed and high current switching which is required for high resolution large displays.

A color filter (not shown) including a pigment layer which transmits any of colors such R (red), G (green) and B (blue) to pixels may be disposed any of the active substrate and the opposite substrate. In this case, a color liquid crystal monitor is provided.

The liquid crystal display devices of the above-mentioned embodiment achieve high operation rate of pixels and reduction in brightness non-uniformity on screen and flicker and are preferably used for liquid crystal projectors. The liquid crystal display devices of the above-mentioned embodiment are preferably used for portable or mobile terminal devices such as liquid crystal monitors, cellular phones, PDAs (personal digital assistants). Although embodiments has been described by way of an example wherein the data line is connected to source of a pixel transistor (TFT) and a drain of the pixel transistor is connected to the pixel electrode, another configuration may be used wherein the drain of the pixel transistor (TFT) is connected to the data line and the source of the pixel transistor is connected to the pixel electrode.

The present invention achieves a high aperture ratio of pixels and reduction in brightness non-uniformity on screen and flicker and is preferably applicable to liquid crystal projectors, liquid crystal monitors, various intelligent devices such as communication terminals and mobile terminal.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A method for driving a liquid crystal display device which comprises a first substrate and a second substrate opposing the first substrate and having a common electrode so as to sandwich the liquid crystal;

the first substrate comprising:

a plurality of data lines and a plurality of gate lines arrayed crosswise; and a pixel matrix having a plurality of pixels, each being disposed at each of intersections between said data lines and said gate lines, each pixel having a pixel transistor and a pixel capacitor;

said pixel being driven by said gate line arranged common for each pixel row, and the data line arranged common to each pixel column;

wherein said driving method comprises:

in one vertical period during which signals of one frame are written into said pixel matrix, selecting a gate line per one horizontal period during which signals of one pixel row of the pixel matrix are written; and writing video signals supplied to said data lines into the pixels of one pixel row connected said selected gate line;

said selecting said gate line(s) is performed by:

dividing the pixel matrix into a plurality of units of a plurality of gate lines; and selecting said gate lines in timely adjacent (contiguous) vertical periods so as to be included in different divided pixel regions;

said data lines are driven such that polarities of the video signals supplied to any one of said data lines relative to a potential of the common electrode are different from one horizontal period to another timely adjacent (contiguous) ones; and in said one vertical period, the polarities of the image signals written into all the pixels in each of said divided pixel regions relative to the potential of said common electrode are the same.

2. The method according to claim 1, wherein each of said pixel regions has equal or substantially equal number of gate lines.

3. The method according to claim 1, wherein the number of said divided pixel regions is an even number.

4. The method according to claim 1, wherein numbers are assigned to the pixel regions and to the pixel row in the pixel region, from the position nearest to one of side edges of the liquid crystal display device, said side edges being parallel with a longitudinal direction of the gate line; and writing of signals into all pixels in said pixel matrix is conducted by repeating steps of writing of signals into the first pixel rows of the first to n-th pixel regions by writing signals into the first pixel row in the first pixel region, thereafter writing signals into the first row in the second pixel region and so on until writing of signals into the first pixel row in n-th pixel region; and subsequently writing signals into i-th pixel row of the first to n-th pixel regions by writing signals into i-th pixel row in the first pixel region, thereafter writing i-th pixel row in the second pixel region and so on until writing of signals into i-th pixel row in n-th pixel regions, wherein i is incremented from 2 to k which is the number of pixel columns in pixel regions.

5. The method according to claim 1, wherein said vertical period during which signals are once written into all pixels of said pixel matrix is 8.34 ms or less.

6. The method according to claim 1, wherein a predetermined voltage is written to the data line per one horizontal period during which signals of one pixel row of the pixel matrix are written.

7. The method according to claim 1, wherein each pixel includes a set of a pixel transistor, a pixel capacitor and a storage capacitor;

said pixel transistor having a gate terminal thereof connected to said gate line arranged common for each pixel row, having a source terminal thereof connected to the data line arranged common to each pixel column, and having a drain electrode thereof connected to the pixel capacitor and the storage capacitor of the pixel associated with said pixel transistor.

* * * * *